US012359395B2

(12) United States Patent
Gerber et al.

(10) Patent No.: US 12,359,395 B2
(45) Date of Patent: Jul. 15, 2025

(54) POWER RAKE

(71) Applicant: Venture Products, Inc., Orrville, OH (US)

(72) Inventors: Corey Gerber, Smithville, OH (US); Josiah Daniel Ramseyer, Orrville, OH (US)

(73) Assignee: Venture Products, Inc., Orrville, OH (US)

( * ) Notice: Subject to any disclaimer, the term of this patent is extended or adjusted under 35 U.S.C. 154(b) by 796 days.

(21) Appl. No.: 17/553,959

(22) Filed: Dec. 17, 2021

(65) Prior Publication Data

US 2023/0087006 A1 Mar. 23, 2023

Related U.S. Application Data

(60) Provisional application No. 63/247,059, filed on Sep. 22, 2021.

(51) Int. Cl.
*E02F 3/78* (2006.01)
*E02F 3/18* (2006.01)

(52) U.S. Cl.
CPC ..... *E02F 3/783* (2013.01); *E02F 3/188* (2013.01)

(58) Field of Classification Search
CPC ... E02F 3/783; E02F 3/20; E02F 3/243; E02F 3/188; E02F 3/183; E02F 3/76; E02F 3/78; E01C 23/088; A01B 45/026; A01B 45/00; A01B 9/00; A01B 9/003; A01B 33/00; A01B 45/02; A01B 45/023
See application file for complete search history.

(56) References Cited

U.S. PATENT DOCUMENTS 3,092,922 A * 6/1963 Knapp ..... A01B 31/00 172/779
3,921,373 A 11/1975 Rubin
5,259,692 A * 11/1993 Beller ..... E02F 3/188 404/90

(Continued)

OTHER PUBLICATIONS

Ventrac KP540 Power Rake; Ventrac by Venture Products, Inc. 2022; 9 pages.

(Continued)

*Primary Examiner* — Adam J Behrens
*Assistant Examiner* — Blake E Scoville
(74) *Attorney, Agent, or Firm* — Sand, Sebolt & Wernow Co., LPA

(57) ABSTRACT

A power rake for attachment with a vehicle. The power rake includes a main frame. The power rake also includes an adjustment assembly operably engaged with the main frame, and the adjustment assembly is independently moveable relative to the main frame. The power rake also includes a rotor assembly operably engaged with the adjustment assembly, and the rotor assembly is independently moveable relative to the main frame by the adjustment assembly. The rotor assembly is adapted to be pivoted via the adjustment assembly relative to a vertical axis of the main frame. The adjustment assembly and the rotor assembly are selectively vertically adjustable relative to a vertical axis of the main frame. The rotor assembly is selectively rotatably adjustable relative to a vertical axis of the main frame.

25 Claims, 24 Drawing Sheets

(56) References Cited

U.S. PATENT DOCUMENTS

| | | | | |
|---|---|---|---|---|
| 5,373,902 | A * | 12/1994 | Lindblom | E02F 3/188 404/90 |
| 5,864,970 | A * | 2/1999 | Maddock | E02F 3/246 404/91 |
| 6,032,746 | A * | 3/2000 | Lowery | E02F 3/844 172/779 |
| 6,247,757 | B1 * | 6/2001 | Cochran | E01C 23/088 404/90 |
| 6,257,342 | B1 * | 7/2001 | Szatko | A01B 49/027 172/540 |
| 6,435,766 | B1 | 8/2002 | Titford | |
| 6,497,294 | B2 * | 12/2002 | Vought | A01B 73/00 172/554 |
| 7,144,087 | B2 * | 12/2006 | Haroldsen | E01C 23/088 404/94 |
| 9,408,339 | B2 | 8/2016 | Jensen et al. | |
| 10,086,867 | B2 * | 10/2018 | Haroldsen | B62D 5/20 |
| 10,568,254 | B2 | 2/2020 | Steiner et al. | |
| 10,674,653 | B2 | 6/2020 | Lofbacka et al. | |
| 10,676,894 | B2 | 6/2020 | Sharp | |
| 11,118,321 | B2 | 9/2021 | Lehman | |
| 2006/0249293 | A1 | 11/2006 | Christian | |
| 2021/0246628 | A1 * | 8/2021 | Wielenberg | A01B 29/045 |

OTHER PUBLICATIONS skidsteers.com; Power Rake—Extreme Duty / Blue Diamond; 1999-2021 Skidsteers.com; 6 pages.

* cited by examiner

POWER RAKE

CROSS REFERENCE TO RELATED APPLICATIONS

This application claims the benefit of U.S. Provisional Application Ser. No. 63/247,059, filed on Sep. 22, 2021; the disclosure of which is incorporated herein by reference.

TECHNICAL FIELD

The present disclosure relates generally to an implement. More particularly, the present disclosure relates to a power rake operably engaged with a vehicle for resurfacing or reshaping uneven terrain. Specifically, the present disclosure relates to a power rake operably engaged with a vehicle for resurfacing or reshaping uneven terrain via a rotor assembly that is moveable in multiple directions.

BACKGROUND

Power rakes are versatile tools for reshaping and resurfacing different types of uneven and rugged terrain. A power rake is typically engaged with a utility vehicle and may be used in a wide variety of landscaping operations such as leveling uneven terrain at a work area, grading a leveled terrain, restoring gravel pathways, walkways, or driveways, or removing weeds from a work area. It may be difficult to reshape and resurface certain types of terrain based on the type of material to be resurfaced or reshaped, the spatial constraints around an area that has to be resurfaced or reshaped, and the amount of time available to resurface or reshape a work area.

If the material being worked by the power rake at the work area is compacted or hard material like gravel or compacted soil, typically an operator will slow down the motion of the vehicle to allow the power rake more time to work the hard or compacted material. In other instances, the footprint of the power rake and vehicle may be too large for the area being resurfaced or reworked or there may be obstacles in the work area that hinder or interfere with the operation of the power rake. In these instances, the operator may have to disengage a first power rake from the vehicle and reengage a second smaller power rake with the vehicle in order to resurface or reshape the smaller work area or avoid the obstructions. This can obviously only occur if the operator has access to more than one size of power rake. In other situations, either because of the type of material being worked or because of space constraints, the operator may need to shut off the power rake and manually resurface or reshape the work area themselves. The need for access to multiple power rakes or the need for the operator to manually work the surface will add to the time, labor, and cost of the operation.

SUMMARY

The presently disclosed power rake includes a variable controlled rotor for resurfacing and reshaping different types of terrain where the rotor may be vertically adjusted and rotatably adjusted and therefore provides the operator with multiple options for reshaping or resurfacing different terrains. The disclosed power rake also provides the operator with a single device having the capability of creating swales or runoff areas, which reduces the project's completion time since the need for creating a swale or runoff with different devices is avoided. Furthermore, the adjustment of the power rake may be controlled by a control system on the vehicle that reduces the amount of time needed to adjust the rotor during a raking operation. As such, the power rake disclosed herein addresses some of the inadequacies of previously known power rakes.

In one aspect, an exemplary embodiment of the present disclosure may provide a power rake for attachment with a vehicle. The power rake may include a main frame. The power rake may also include an adjustment assembly operably engaged with the main frame, wherein the adjustment assembly is independently moveable relative to the main frame. The power rake may also include a rotor assembly operably engaged with the adjustment assembly, wherein the rotor assembly is independently moveable relative to the main frame by the adjustment assembly.

This exemplary embodiment or another exemplary embodiment may further provide that the rotor assembly is adapted to be pivoted via the adjustment assembly relative to a vertical axis of the main frame. This exemplary embodiment or another exemplary embodiment may further provide that the adjustment assembly and the rotor assembly are selectively vertically adjustable relative to a vertical axis of the main frame. This exemplary embodiment or another exemplary embodiment may further provide that the rotor assembly is selectively rotatably adjustable relative to a vertical axis of the main frame. This exemplary embodiment or another exemplary embodiment may further provide that the rotor assembly further comprises a rotor frame operably engaged with the adjustment assembly; a rotor operably engaged with the rotor frame; and a motor operably connected to the rotor, wherein the motor selectively moves the rotor during operation. This exemplary embodiment or another exemplary embodiment may further provide that the rotor is selectively moveable between a clockwise rotation and a counterclockwise rotation. This exemplary embodiment or another exemplary embodiment may further provide that the rotor is selectively moveable between a first speed of rotation and a second speed of rotation that is greater than the first speed of rotation. This exemplary embodiment or another exemplary embodiment may further provide a front axle operably engaged with the main frame forwardly of the rotor assembly. This exemplary embodiment or another exemplary embodiment may further provide a longitudinal axis defined by the main frame; wherein the front axle is independently rotatable about an axis parallel to the longitudinal axis of the main frame. This exemplary embodiment or another exemplary embodiment may further provide that the front axle further comprises a support bar; at least one wheel operably engaged with the support bar; an attachment bar operably engaged with the support bar, wherein the attachment bar is orthogonal to the support bar; and a retaining pin operably engaged with the attachment bar to removably attach the attachment bar to the main frame. This exemplary embodiment or another exemplary embodiment may further provide that the front axle further comprise a vertical plate operably engaged with one of the support bar and the attachment bar; a slot defined by the mounting plate; and a retaining mechanism operably engaged with main frame, wherein the retaining mechanism restricts movement of the front axle relative to the main frame. This exemplary embodiment or another exemplary embodiment may further provide a locking mechanism which prevents movement of the front axle relative to the main frame. This exemplary embodiment or another exemplary embodiment may further provide that wherein the adjustment assembly further comprises a pivot assembly operably engaged with the rotor assembly, wherein the pivot assembly is operable to pivot the rotor assembly about an axis of the main frame. This exemplary embodiment or another exemplary embodiment may further provide that the pivot assembly further comprises an upper member operably engaged with the main frame, the upper member defining a first opening that is oblong; a lower member operably engaged with the rotor assembly, the lower member defining a second opening that is oblong and oriented orthogonally to the first opening; and a locking mechanism operably engaging the upper member with the lower member via the first opening and the second opening. This exemplary embodiment or another exemplary embodiment may further provide that the lower member is movable between a first position and a second position relative to the upper member; and wherein a first end of the rotor is disposed at a first height and a second end of the rotor is disposed at a second height greater than the first height when the lower member is at the first position. This exemplary embodiment or another exemplary embodiment may further provide that the first end of the rotor is disposed at a third height and the second end of the rotor is disposed at a fourth height less than the third height when the lower member is at the second position. This exemplary embodiment or another exemplary embodiment may further provide a depth measurement assembly operably engaged with the pivot assembly and adapted to measure a height and a depth of the rotor relative to a bottom of the main frame.

In another aspect, and exemplary embodiment of the present disclosure may provide a method of reshaping uneven terrain. The method comprising steps of: operably engaging a power rake with a vehicle; adjusting a rotor assembly of the power rake relative to a main frame of the power rake via an adjustment assembly; selecting a direction of rotation of a rotor of the rotor assembly; selecting a speed of rotation for the rotor of the rotor assembly; rotating the rotor in the selected direction of rotation and at the selected speed of rotation with a motor; contacting the uneven terrain with the rotating rotor; traversing over the uneven terrain; and reshaping said uneven terrain with the rotating rotor.

This exemplary embodiment or another exemplary embodiment may further provide steps of operably engaging an attachment bar of a front axle with the main frame; and stabilizing a front end of the main frame with the front axle. This exemplary embodiment or another exemplary embodiment may further provide steps of raising the rotor assembly until the rotor is out of contact with the uneven terrain; loosening a locking mechanism on a pivot assembly that engages the rotor assembly to the main frame; articulating the rotor; orienting the rotor at a desired angle relative to the main frame; tightening the locking mechanism to maintain the rotor at the desired angle; lowering the rotor to contact the uneven terrain; activating the rotor; and creating a swale in the uneven terrain. This exemplary embodiment or another exemplary embodiment may further provide a step of vertically adjusting the rotor assembly along a vertical axis of the main frame. This exemplary embodiment or another exemplary embodiment may further provide a step of rotatably adjusting the rotor assembly—about a vertical axis of the main frame. This exemplary embodiment or another exemplary embodiment may further provide a step of pivoting the rotor assembly relative to a horizontal axis of the main frame. This exemplary embodiment or another exemplary embodiment may further provide that the step of selecting the speed of rotation of the rotor of the rotor assembly includes selecting one of a first rotational speed and a second rotational speed that is greater than the first rotational speed. This exemplary embodiment or another exemplary embodiment may further provide that the step of selecting the direction of rotation of the rotor of the rotor assembly includes selecting one of a clockwise direction and a counterclockwise direction. This exemplary embodiment or another exemplary embodiment may further provide a step of determining a vertical position of the rotor relative to the main frame via a depth measurement assembly.

BRIEF DESCRIPTION OF THE SEVERAL VIEWS OF THE DRAWINGS

Sample embodiments of the present disclosure are set forth in the following description, are shown in the drawings and are particularly and distinctly pointed out and set forth in the appended claims.

Similar numbers refer to similar parts throughout the drawings.

DETAILED DESCRIPTION

Figure 1:
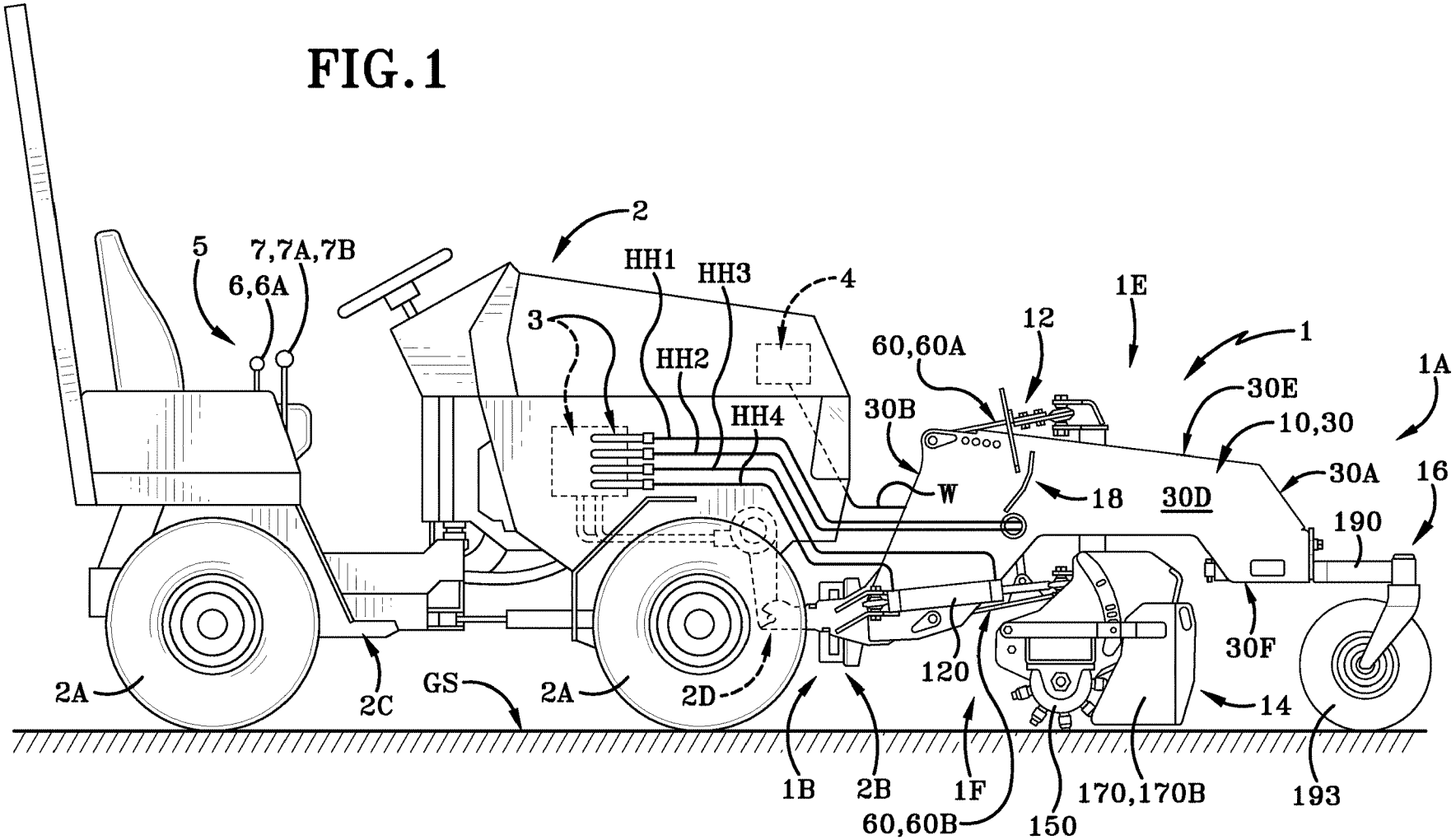
FIG. 1 (FIG. 1) is a right side elevation view of a power rake operably engaged with a tractor in accordance with an aspect of the present disclosure FIG. 2 (FIG. 2) is a rear, top, right side isometric perspective view of the power rake shown in FIG. 1; wherein the power rake is detached from the tractor.
Figure 2:
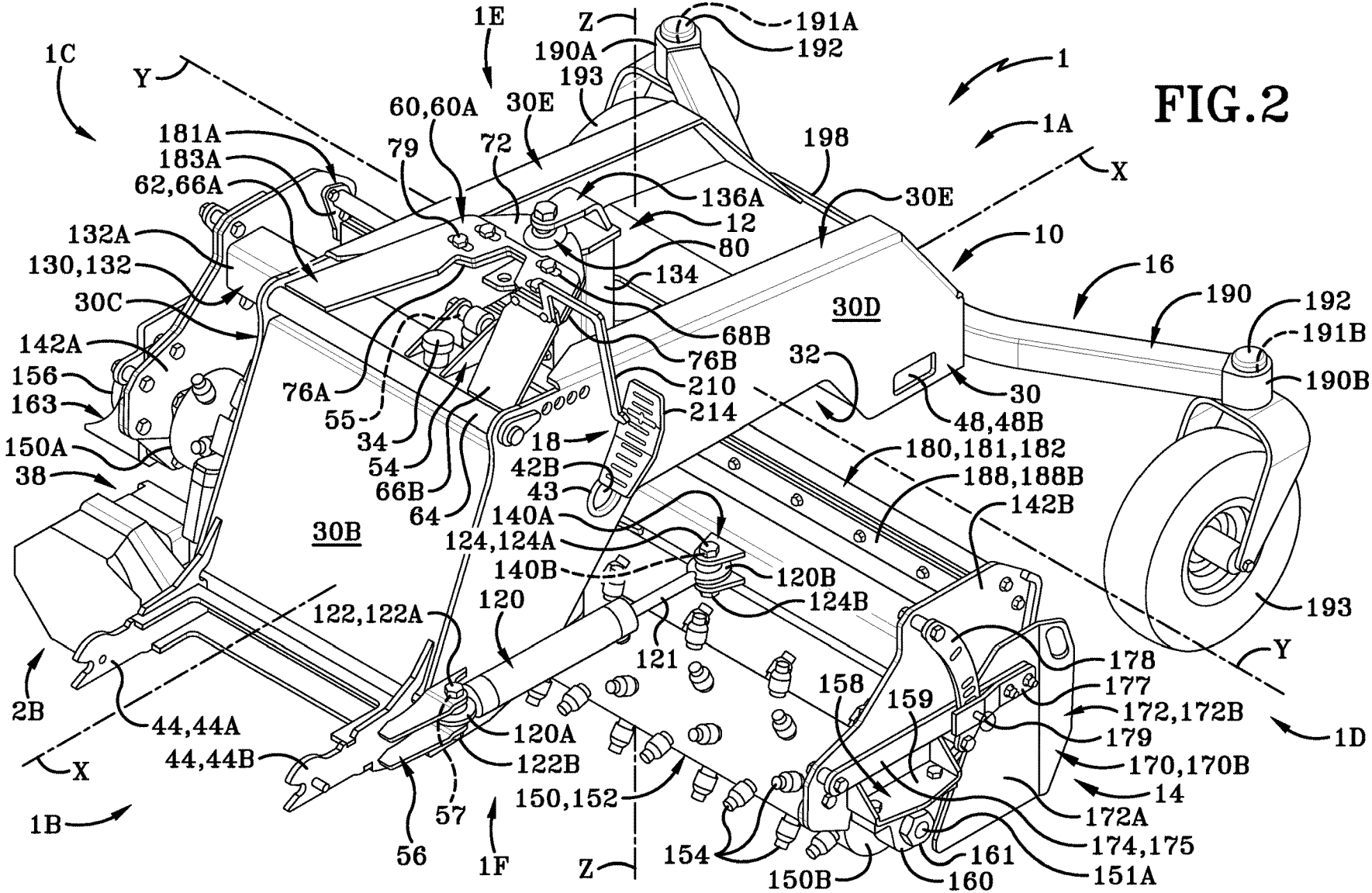
Figure 3:
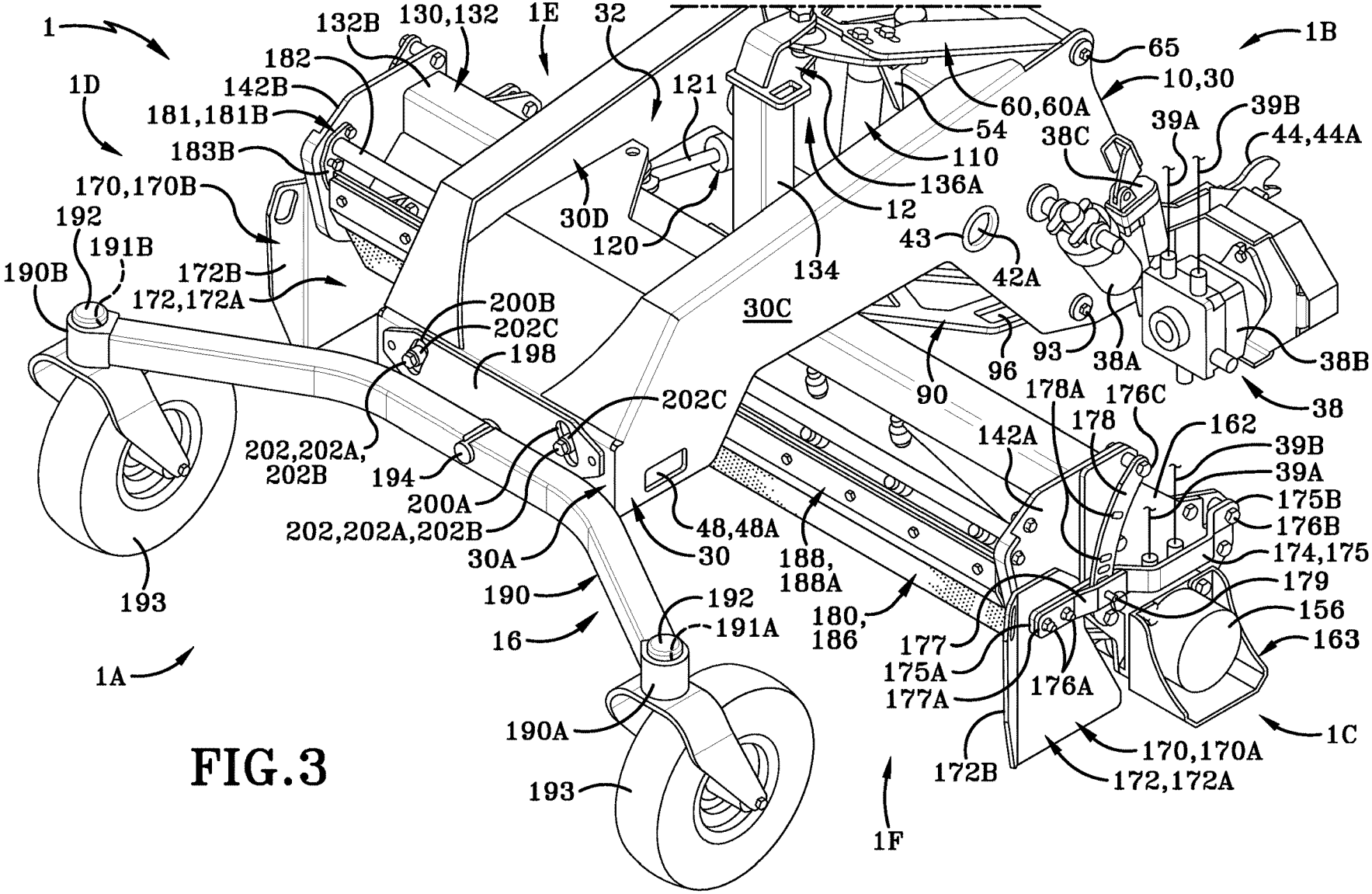
FIG. 3 (FIG. 3) is a partial front, top, left side isometric perspective view of the power rake shown in FIG. 1; wherein the power rake is detached from the tractor.

An outdoor power equipment device, which may also be referred to as a power rake, is generally shown throughout the figures at 1. Referring to FIGS. 1-3, Power rake 1 includes a front end 1A, an opposing rear end 1B, and a longitudinal axis defined therebetween. Power rake 1 also includes a first side or left side 1C, an opposing second side or right side 1D, and a transverse axis defined therebetween. Power rake 1 also include a top end 1E, an opposing bottom end 1F, and a vertical axis defined therebetween.

It should be understood that the terms "front", "rear", "top", "bottom", "left", and "right" are used to described the orientation of the power rake 1 illustrated in the attached figures and should in no way be considered to limit the orientation that the power rake 1 may be utilized. In addition, the use of the directional terms "front", "rear", "top", "bottom", "left", and "right" is taken in perspective of FIG. 2 (i.e. viewing the power rake 1 from the rear end 1B).

Referring to FIG. 1, the power rake 1 is configured to operably engage with a drivable outdoor power equipment device shown generally at 2, which may also be referred to as a tractor 2, including at least on ground engaging wheel 2A. The tractor may include a power takeoff (PTO) connector 2B that connects with the power rake 1. In one particular embodiment, power rake 1 is offset forwardly from a forward ground engaging wheel 2A on tractor 2. One exemplary tractor 2 for use with power rake 1 is a Ventrac compact tractor commercially available for sale and known in the industry as a Ventrac 4500 tractor. The tractor 2 may include an all-wheel drive system in addition to an articulating tractor frame 2C.

Still referring to FIG. 1, tractor 2 may further include a mechanical power assembly 3 that is configured to operably engage with the power rake 1. An operator of the tractor 2 may be able to operate the mechanical power assembly 3 to articulate and/or manipulate certain components during operation of the power rake 1, which is described in more detail below. In the illustrated embodiment, the mechanical power assembly 3 is a hydraulic assembly that operably engages with the power rake 1 to articulate and/or manipulate certain components during operation of the power rake 1. In other exemplary embodiments, a tractor may include any suitable power assembly that operably engages with a power rake to articulate and/or manipulate certain components during operation of the power rake. Examples of suitable assemblies used to articulate and/or manipulate certain components during operation of a power rake include pneumatic assemblies, electrical assemblies, and other suitable assemblies of the like configured to articulate and/or manipulate certain components during operation of the power rake. Additionally Still referring to FIG. 1, tractor 2 may further include an electrical power assembly 4 that is configured to operably engage with the power rake 1. An operator of the tractor 2 may be able to operate the electrical power assembly 4 to articulate and/or manipulate certain components during operation of the power rake 1, which is described in more detail below.

Still referring to FIG. 1, tractor 2 may further include a control system 5 that is operatively engaged with the mechanical power assembly 3 and the electrical power assembly 4 of tractor 2. The control system 5 may include a first control lever 6 with a button 6A that operatively controls certain components and/or assemblies on the power rake 1 operatively engaged with the mechanical power assembly 3. Such use of the first control lever 6 with the button 6A during a raking operation is described in more detail below. The control system 5 may include a second control lever 7 with a first switch 7A and a second switch 7B that operatively control certain components and/or assemblies on the power rake 1 operatively engaged with the electrical power assembly 4. Such use of the second control lever 7 with the first switch 7A and second switch 7B during a raking operation is described in more detail below.

Referring to FIGS. 1-3, the power rake 1 may include a main frame 10 that operably engages the power rake 1 to the tractor 2. The power rake 1 may also include an adjustment assembly 12 that is operably engaged with the main frame 1. The power rake 1 may also include rotor assembly 14 that is operably engaged with the adjustment assembly 12. In the illustrated embodiment, the adjustment assembly 12 and the rotor assembly 14 may be independently collectively moveable relative to the main frame 10, which is described in more detail below. In addition, the adjustment assembly 12 and the rotor assembly 14 may be hydraulically selectively vertically adjustable relative to the main frame 10 of the power rake 1. The rotor assembly 14 may also be hydraulically selectively rotatably adjustable relative to the main frame 10 of the power rake 1. Still referring to FIGS. 1-3, the power rake 1 may include a front axle 16 that is operably engaged with the main frame 10 to provide stability at the front end 1A of the power rake 1. In the illustrated embodiment, the front axle 16 may be independently rotatable relative to the main frame 10. Still referring to FIGS. 1-3, the power rake may include a depth measurement assembly 18 operably engaged with the adjustment assembly 12 and the main frame 10 for measuring the depth of the rotor assembly relative to the bottom of the main frame 10 or the bottom end 30F of the housing 30, which is described in more detail below.

Referring to FIGS. 2-3, the main frame 10 includes a housing 30. The housing 30 includes a front wall 30A proximate to the front end 1A of the power rake 1, an opposing rear tank 30B proximate to the rear end 1B of the power rake 1, and a longitudinal axis "X" defined therebetween. The housing 30 also includes a first lateral wall or left wall 30C proximate to the left side 1C of the power rake 1, an opposing second lateral wall or right wall 30D proximate to the right side 1D of the power rake 1, and a transverse axis "Y" defined therebetween. The housing 30 also includes a top end 30E, an opposing bottom end 30F, and a vertical axis "Z" defined therebetween. Each of the front wall 30A, the rear tank 30B, the left wall 30C, and the right wall 30D collectively define a central opening 32 where the adjustment assembly 12 and the rotor assembly 14 may articulate upwardly and downwardly during a raking operation, which is described in more detail below.

Figure 5:
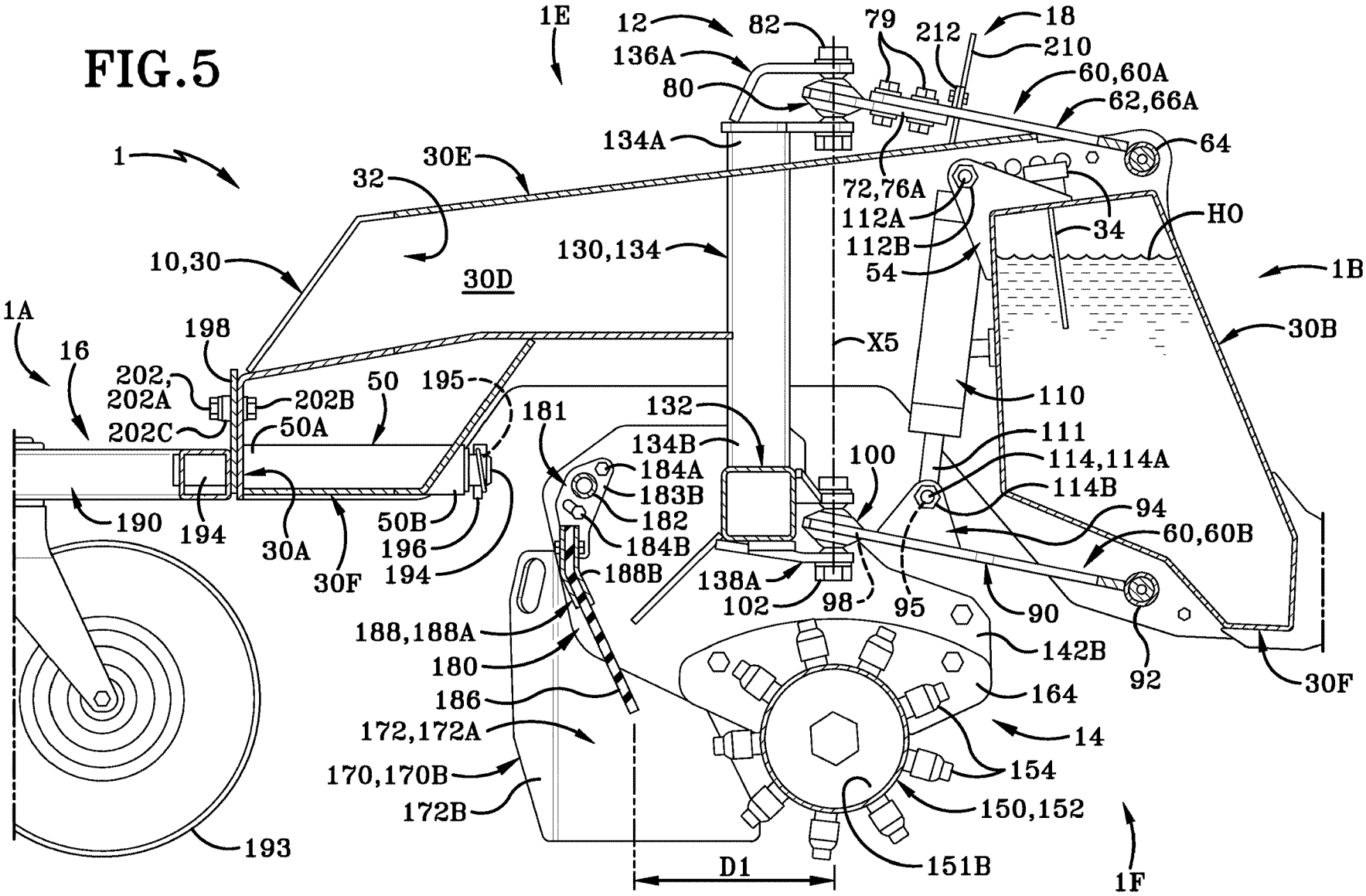
FIG. 5 (FIG. 5) is a partial longitudinal section view taken in the direction of line 5-5 labeled in FIG. 4.

Referring to FIG. 5, the rear tank 30B holds hydraulic oil "HO" which may supply hydraulic oil to certain components and/or devices on the power rake 1. The rear tank 30B may include a dipstick device or plug 34 to cover the inlet opening of the rear tank 30B. Removal of the dipstick device 34 provides access to the rear tank 30 such that the operator of the power rake 1 may pour hydraulic oil "HO" into the rear tank 30B for operating the adjustment assembly 12, which is described in more detail below. Additionally, the rear tank 30B may also define additional openings or outlets to distribute hydraulic oil to other components or devices on the power rake 1 or to drain hydraulic oil from the rear tank 30B for maintenance and repair matters.

As illustrated in FIGS. 2 and 3, a hydraulic system 38 may be operably engaged with the rear tank 30B in order to operate the adjustment assembly 12 and the rotor assembly 14 during a raking operation. The hydraulic assembly 38 may include any suitable devices and/or components to operate the adjustment assembly 12 and the rotor assembly 14 during a raking operation. As illustrated in FIG. 3, the hydraulic system 38 may include a hydraulic filter assembly 38A that is operably engaged with an outlet defined by the rear tank 30B and the left wall 30C where the hydraulic filter assembly 38A is in fluid communication with the rear tank 30B. Generally, the hydraulic filter assembly 38A filters the hydraulic oil before the hydraulic oil flows to other devices and components provided in the hydraulic system 38. The hydraulic system 38 may also include a hydraulic pump 38B that is operably engaged with an outlet of the hydraulic filter assembly 38A. The hydraulic pump 38B is mechanically powered by the PTO 2B of the tractor 2. The hydraulic system 38 also includes a hydraulic actuator 38C that is operably connected to the hydraulic pump 38B for controlling the speed and direction of the hydraulic pump 38B during a raking operation. The hydraulic actuator 38C may be operatively controlled by an operator, via the second control lever 7 and first and second switches 7A, 7B, to control the speed and direction of a hydraulic motor of the rotor assembly 14 operably engaged with the rotor assembly 14 via the hydraulic pressure created inside of the hydraulic pump 38B. The hydraulic pump 38B is operably connected to the motor of the rotor assembly 14 via first and second hydraulic lines 39A, 39B. Such control over a hydraulic motor of the rotor assembly 14 during a raking operation is described in more detail below.

Figure 7A:
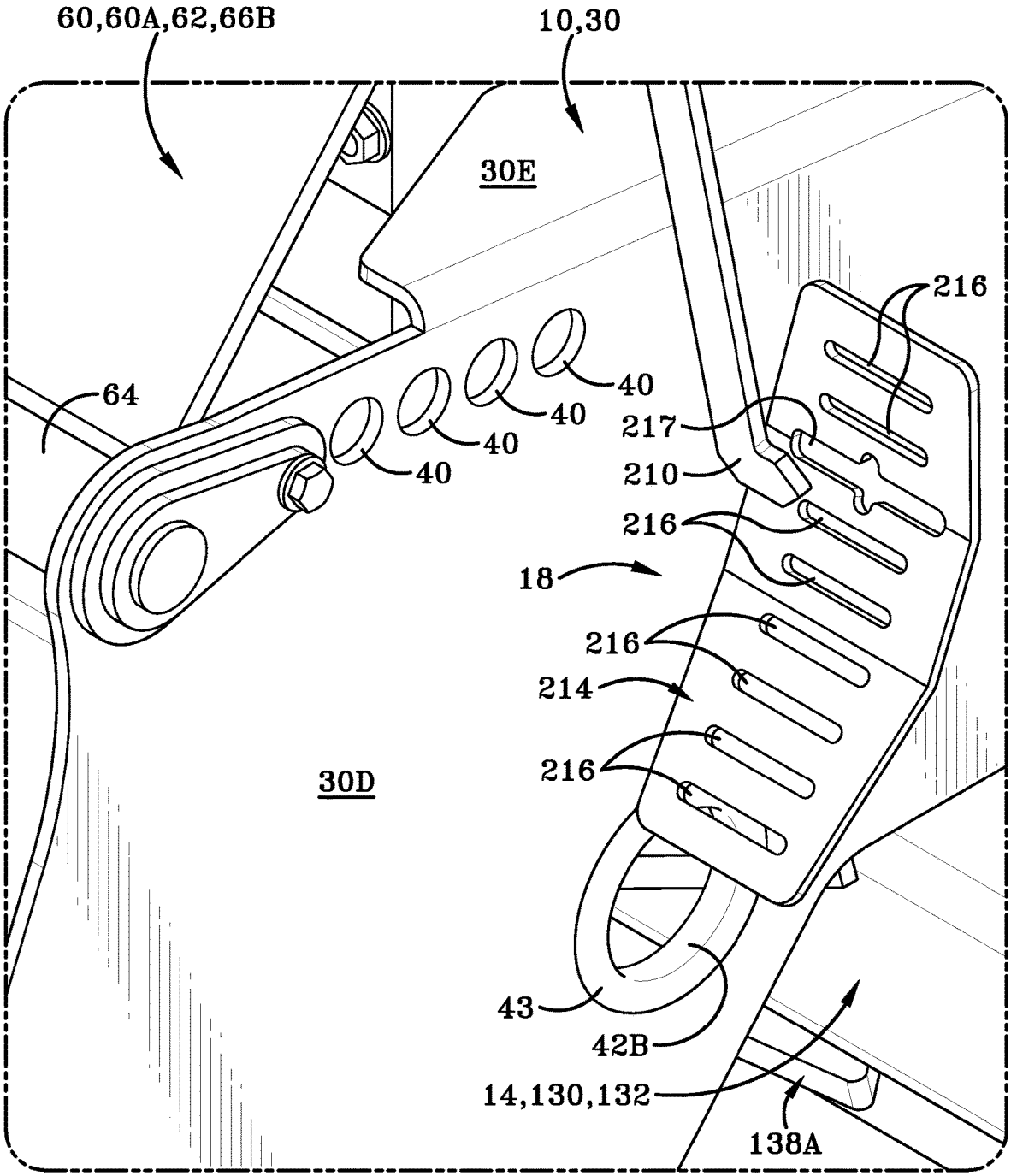
FIG. 7A (FIG. 7A) is a partial rear, top, right side isometric perspective view of the power rake shown in FIG. 1; wherein a plurality of hydraulic hoses of the power rake are disconnected from a plurality of securement hose holes defined in a housing of a main frame of the power rake.

Referring to FIGS. 2 and 7A, the housing 30 may define a set of securement hose holes 40 in the right wall 30D. Each securement hose hole of the set of securement hose holes 40 allows an operator to store a connection end "CE" of a hydraulic hose from a set of hydraulic hoses "HH" used for the adjustment assembly 12 when the power rake 1 is not being used. Such connection and use of the set of hydraulic hoses "HH" during a raking operation is described in more detail below.

In addition, the housing 30 also defines a first through-hole 42A in the left wall 30C of the housing 30 and a second through-hole 42B in the right wall 30D of the housing 30 where the first through-hole 42A and the second through-hole 42B are coaxial with one another. The first through-hole 42A and the second through-hole 42B are sized and configured to allow the housing 30 to receive and hold the hydraulic hoses such that the hydraulic hoses will not interfere with or impeded the movement of any moving components of the power rake 1. In addition, a grommet 43 may be operably engaged with the housing 30 inside of each of the first through-hole 42A and the second through-hole 42B to prevent marring or wear on a hydraulic hose in the set of hydraulic hoses "HH". The grommet 43 inside each of the first through-hole 42A and the second through-hole 42B may also allow the hydraulic hoses "HH" to freely move inside of the first through-hole 42A and the second through-hole 42B during a raking operation.

Referring to FIGS. 1-2, the main frame 10 may include a hitch frame 44 that includes at least one hitch arm to allow the tractor 2 to operably engage with the power rake 1 such that the power rake 1 is maintained with the tractor 2 during a raking operation. In the illustrated embodiment, the hitch frame 44 includes a first hitch arm 44A and a second hitch arm 44B that operably engages with attachment hitch arms 2D on the tractor 2 to maintain the power rake 1 with the tractor 2.

Figure 9A:
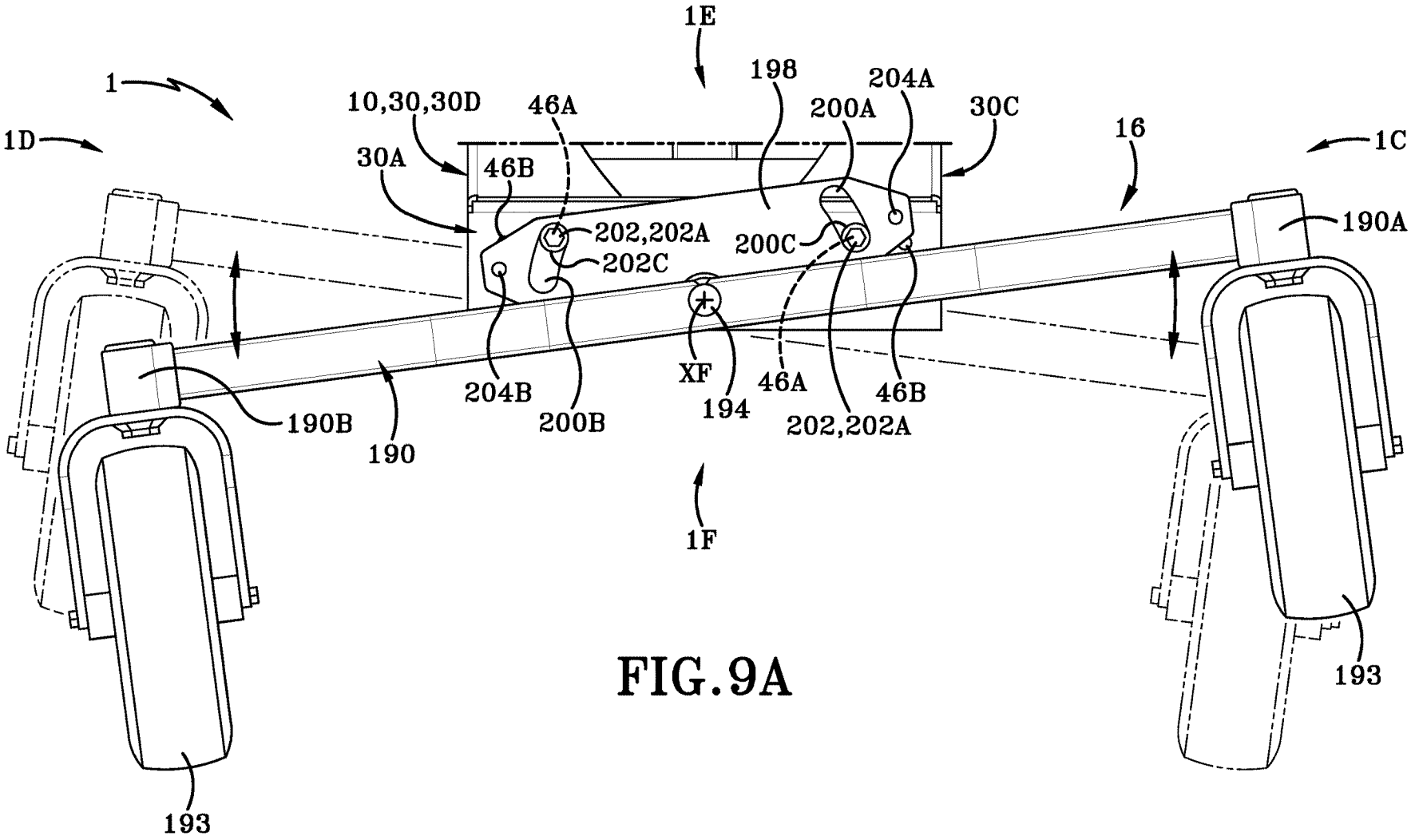
FIG. 9A (FIG. 9A) is a partial front elevation view of a front axle of the power rake, wherein the front axle is freely rotating, via an attachment bar of the front axle, relative to the main frame.

Referring to FIG. 9A, the housing 30 may define a first set of apertures 46A on the front wall 30A of the housing 30 that extends entirely through the front plate 30A relative to the longitudinal axis of the power rake 1. The housing 30 may also define a second set of opening 46B on the front wall 30A of the housing 30 that extends entirely through the front plate 30A relative to the longitudinal axis "X" of the housing 30. In the illustrated embodiment, the first set of apertures 46A is defined proximate to a central point of the front wall 30A whereas the second set of apertures 46B is defined proximate to the outer edge of the front wall 30A. Such use of the first and second sets of apertures 46A, 46B is described in more detail below.

Referring to FIGS. 2-3, the housing 30 may define a set of tie down openings 48. In the illustrated embodiment, a first tie down opening 48A may be defined on the first lateral wall 30C proximate to the front wall 30A of the housing 30. In addition, a second tie down opening 48B may be defined on the second lateral wall 30D proximate to the front wall 30A of the housing 30. In other exemplary embodiments, a housing may define any suitable number of tie down openings at any suitable location on the housing. Each tie down openings of the set of tie down openings 48 provides an operator with designated mounts and/or attachment areas on the power rake 1 for operably engaging a rope, ratchet strap, or similar restraint of the like to safety haul and transport the power rake 1.

Figure 10A:
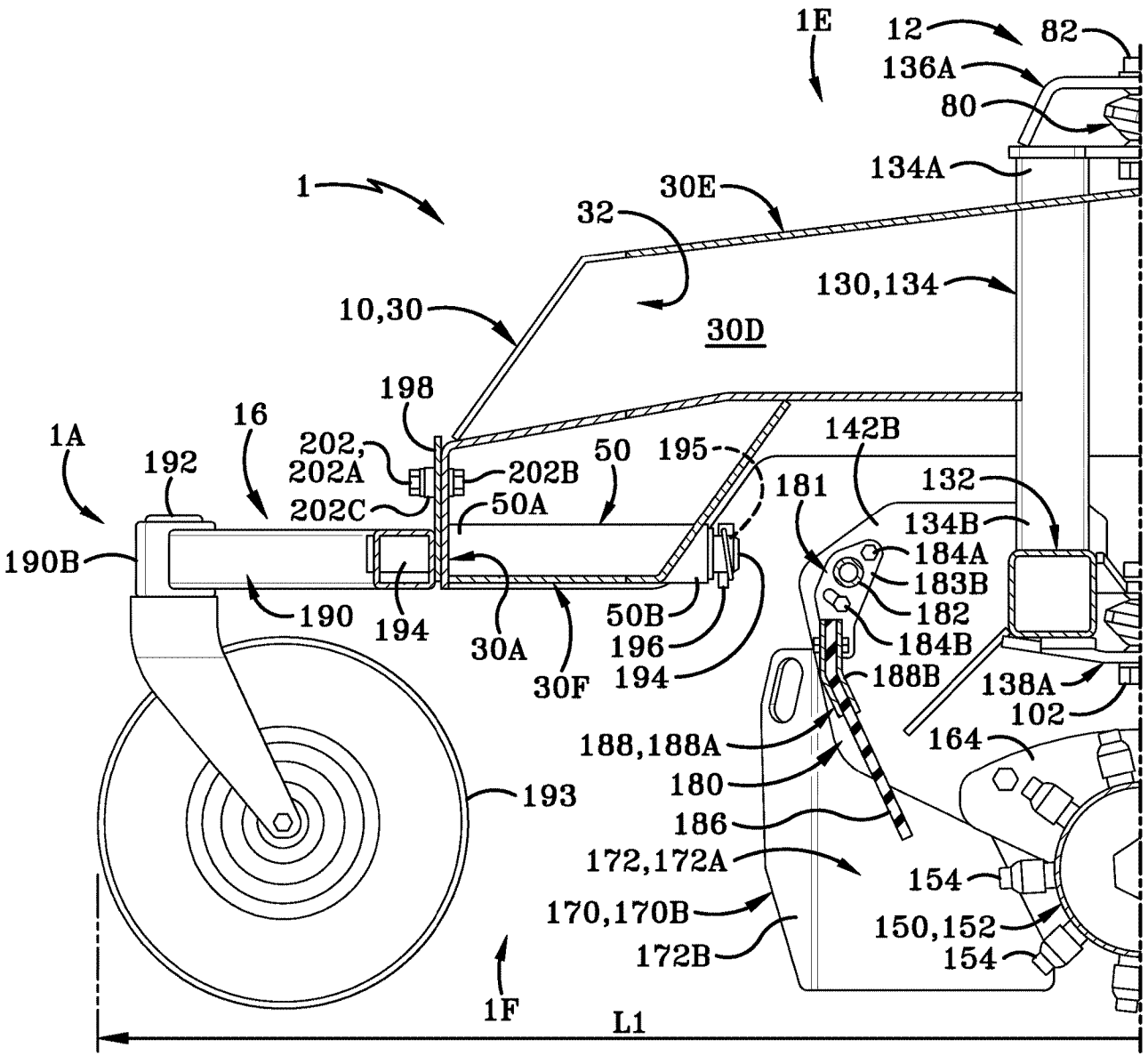
FIG. 10A (FIG. 10A) is a partial longitudinal section view of the power rake; wherein the front axle is operably engaged with the main frame.

Still referring to FIG. 5, the housing 30 may include a tubular member 50 extending from the front end 30A of the housing 30 to the central opening 32 of the housing 30. In one exemplary embodiment, the tubular member 50 may be operably engaged with the front wall 30A of the housing 30 such that tubular member 50 and the front wall 30A are separate members. In one exemplary embodiment, the tubular member 50 may be operably engaged with the front wall 30A of the housing 30 such that tubular member 50 and the front wall 30A is a unitary, monolithic member. As illustrated in FIG. 10A, the tubular member 50 may have a front end 50A, an opposing rear end 50B, and a longitudinal axis defined therebetween. The tubular member 50 may be hollow and defines a passageway that extends entirely through the tubular member 50 from the front end 50A to the rear end 50B along the longitudinal axis of the tubular member 50. The tubular member 50 is configured to operably engaged with the front axle 16, which is described in more detail below.

Referring to FIG. 2, the main frame 10 also has an upper bracket 54. The upper bracket 54 may be operably engaged with the rear tank 30B proximate to the top end 1E of the power rake 1. The upper bracket 54 also defines a set of openings 55 that are coaxial with one another relative to the transverse direction. The upper bracket 54 is configured to operably engage with associated components of the adjustment assembly 12, which is described in more detail below. Still referring to FIG. 2, the main frame 10 also includes an opposing lower bracket 56. The lower bracket 56 may be operably engaged with the rear tank 30B and the hitch frame 44 proximate to the right side 1D of the power rake 1. The lower bracket 56 also defines a set of openings 57 that are coaxial with one another relative to the vertical direction. The lower bracket 56 is configured to operably engage with associated components of the adjustment assembly 12, which is also described in more detail below.

Figure 4:
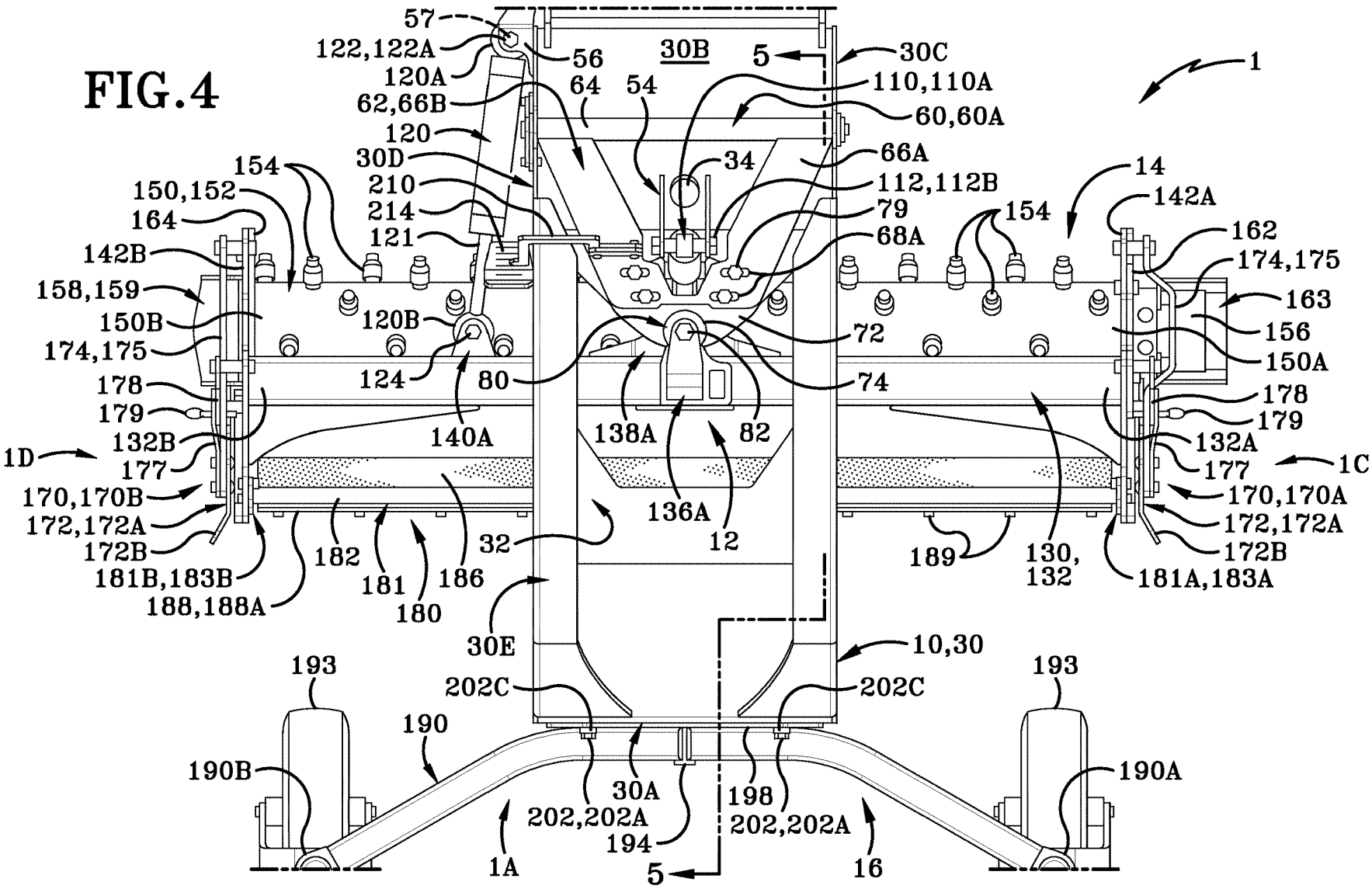
FIG. 4 (FIG. 4) is a partial top plan view of the power rake shown in FIG. 1.

Referring to FIGS. 2-4, the adjustment assembly 12 includes a pivot assembly 60. The pivot assembly 60 has a top pivot assembly 60A and a bottom pivot assembly 60B that may allow the operator of the power rake 1 to pivot the rotor assembly 14 about the longitudinal axis "X" of the housing 30 for creating swales and other similar runoff slopes. Such pivoting of the rotor assembly 14 via the pivot assembly 60 is described in more detail below.

Referring to FIGS. 2 and 4, the top pivot assembly 60A may include an upper frame 62. The upper frame 62 may include an attachment rod 64 that operably engages with the rear tank 30B of the housing 30. During operation, the attachment rod 64 allows the upper frame 62 to pivot about the longitudinal axis of the attachment rod 64 when the adjustment assembly 12 is manipulate by the operator to adjust the rotor assembly 14 (described in more detail below). In addition, bushings and devices of the like may be operably engaged between the attachment rod 64 and the housing 30 to allow the upper frame 62 to freely rotate about the attachment rod 64 when the adjustment assembly 12 is manipulate by the operator during a raking operation. In addition, the upper frame 62 includes a first portion 66A and an opposing second portion 66B operably engaged at the attachment rod 64 and at a terminal end opposite to the attachment rod 64 on the upper frame 62. The upper frame 62 also defines an upper set of adjustment openings 68 on each of the first portion 66A and the second portion 66B. As illustrated in FIGS. 2 and 4, the first portion 66A may define a first upper set of adjustment openings 68A and the second portion 66B may define an opposing second upper set of adjustment openings 68B. The upper set of adjustment openings 68 may also extend entirely through the upper frame 62. The upper set of adjustment openings 68 may also be oblong-shaped such that each adjustment opening of the upper set of adjustment openings 68 extends along the upper frame 62 relative to the transverse axis of the power rake 1.

Figure 14A:
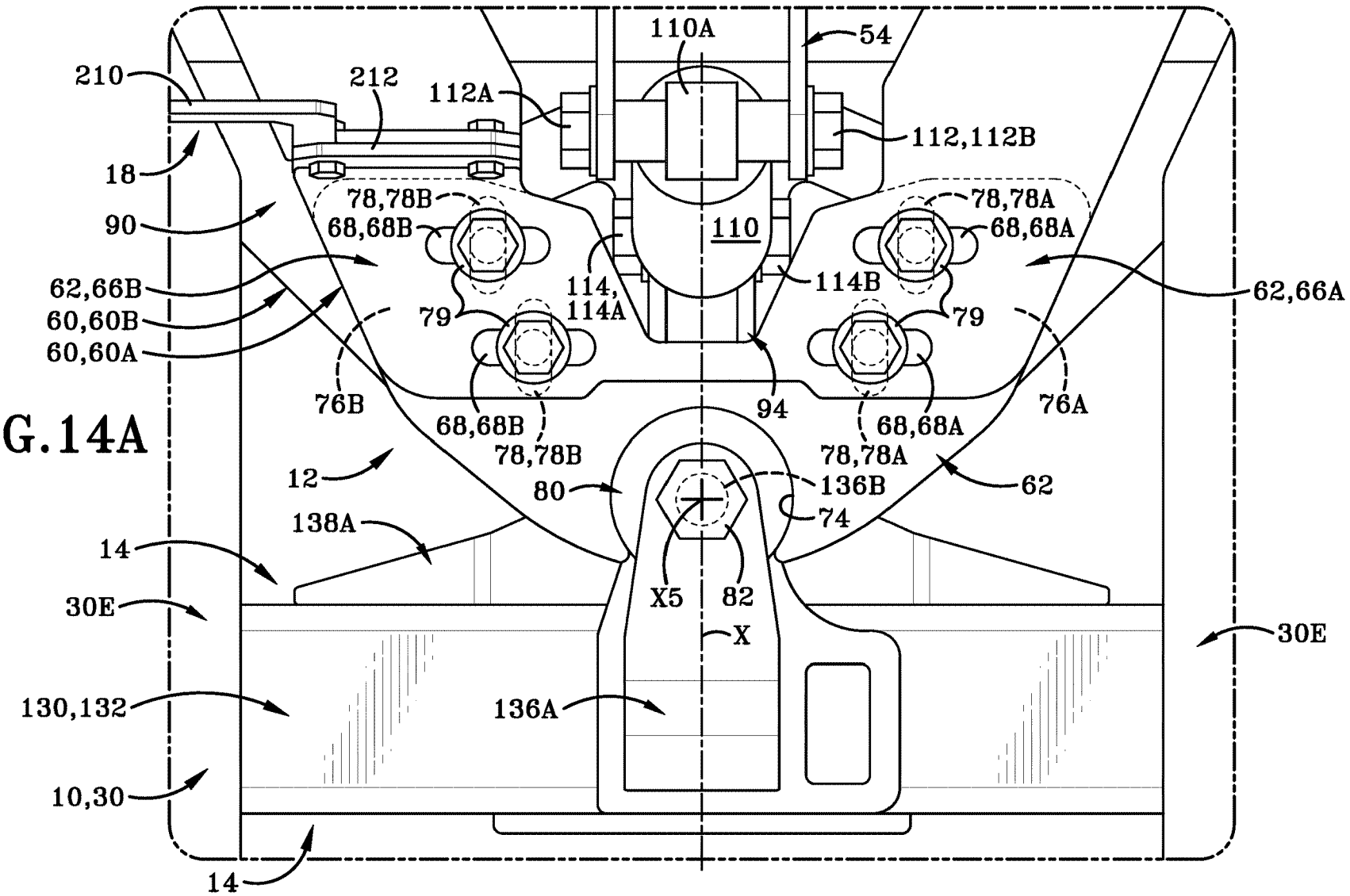
FIG. 14A (FIG. 14A) is a partial top plan view of the power rake, wherein an upper frame and a mounting plate of the pivot assembly are aligned with one another in an upright, non-pivoted position.
Figure 15A:
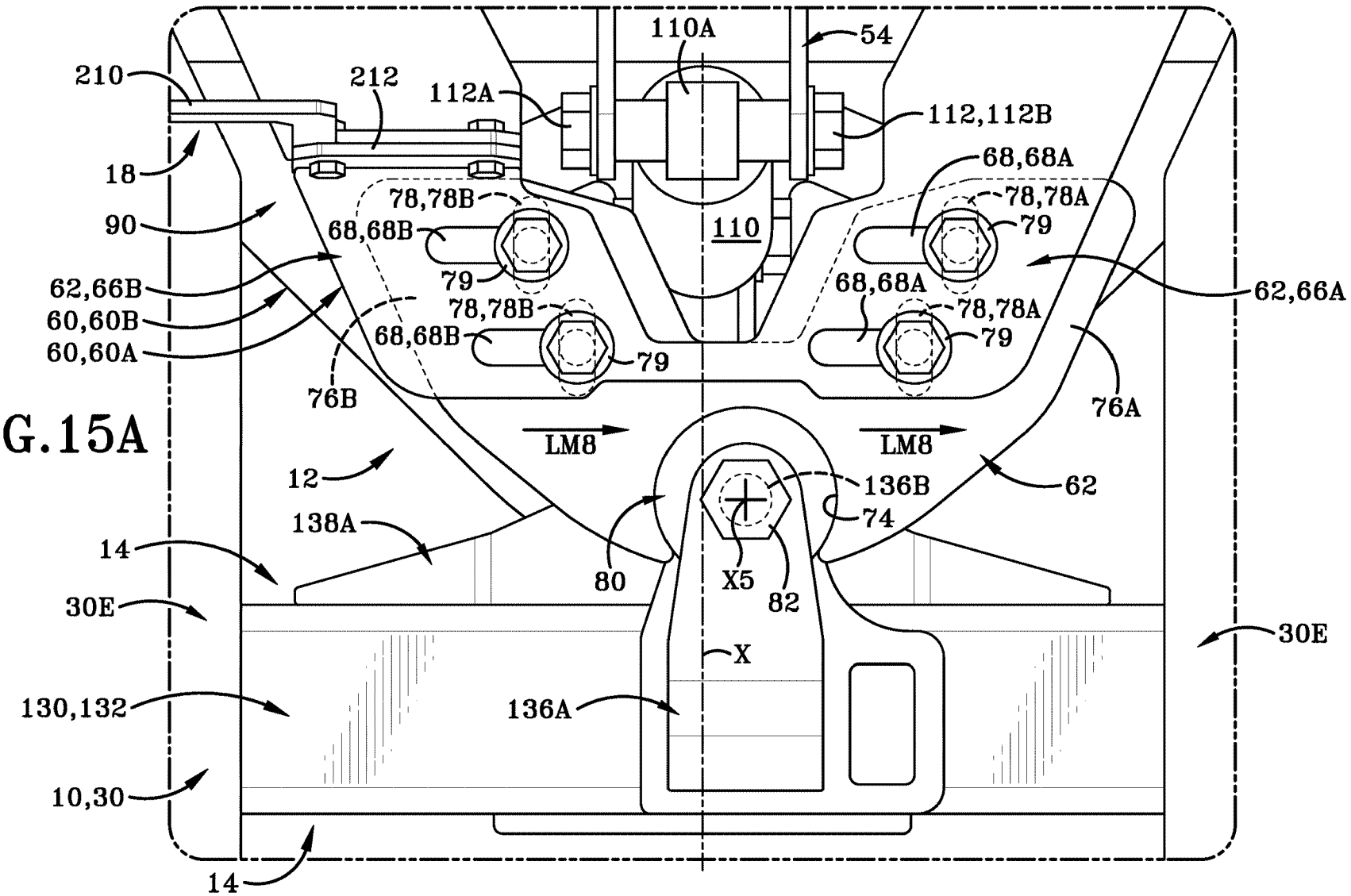
FIG. 15A (FIG. 15A) is a partial top plan view of the power rake, wherein the mounting plate of the pivot assembly is offset from the upper frame in an angled, pivoted position.

Referring to FIGS. 2-4, the top pivot assembly 60A also includes a mounting plate 72. The mounting plate 72 defines a front notch 74 that extends into the mounting plate 72 from a front end of the mounting plate 72. The purpose of the front notch 74 is described in more detail below. The mounting plate 72 also includes first portion 76A and an opposing second portion 76B. The mounting plate 72 also defines a lower set of adjustment openings 78 on each of the first portion 76A and the second portion 76B. As illustrated in FIGS. 14A and 15A, the first portion 76A may define a first lower set of adjustment openings 78A and the second portion 76B may define an opposing second lower set of adjustment openings 78B. The lower set of adjustment openings 78 may also extend entirely through the mounting plate 72. The lower set of adjustment openings 78 may also be oblong-shaped such that each adjustment opening of the lower set of adjustment openings 78 extends along the mounting plate 72 relative to the transverse axis of the power rake 1. In the illustrated embodiment, the lower set of adjustment opening 78 defined by the mounting plate 72 are oriented orthogonally to the upper set of adjustment openings 68 defined by the upper frame 62.

Referring to FIGS. 2-4, 14A, and 15A, the top pivot assembly 60A may also include a set of adjustable securement mechanisms 79 that operably engages the upper frame 62 and the mounting plate 72 with one another. As described in more detail below, the set of adjustment securement mechanisms 79 may allow an operator of the power rake 1 to laterally offset the mounting plate 72 from the upper frame 62 in order to pivot and/or tilt the rotor assembly 14 at a desired angle for creating or resurfacing a swale or other similar runoff slopes. Such offsetting of the upper frame 62 and the mounting plate 72 is described in more detail below.

Still referring to FIGS. 2-4, the top pivot assembly 60A includes an upper linkage assembly 80. The upper linkage assembly 80 is operably engaged with the mounting plate 72 inside of the front notch 74. In the illustrated embodiment, the upper linkage assembly 80 is press-fitted with the mounting plate 72 inside of the front notch 74. In other exemplary embodiments, an upper linkage assembly may be operably engaged with a mounting plate in any suitable arrangement. In the illustrated embodiment, the upper linkage assembly 80 operably engages the top pivot assembly 60A of the adjustment assembly 12 with the rotor assembly 14 via a locking mechanism 82, which is described in more detail below. With this engagement, the upper linkage assembly 80 allows the adjustment assembly 12 to transition the rotor assembly 14 upwardly and downwardly by allowing the top pivot assembly 60A to pivot at the upper linkage assembly 80. In the illustrated embodiment, the upper linkage assembly 80 may include a swiveling ball joint that allows the top pivot assembly 60A to swivel when the adjustment assembly 12 is manipulating the height of the rotor assembly 14 for a desired depth of raking, manipulating the angle of the rotor assembly 14 for a desired angle of raking, or manipulating the pivot angle of the rotor assembly 14 for creating swales or other runoff slopes (described in more detail below).

Referring to FIG. 5, the bottom pivot assembly 60B may include a bottom frame 90. The bottom frame 90 may include an attachment rod 92 that operably engages with the rear tank 30B of the housing 30. During operation, the attachment rod 92 allows the bottom frame 90 to pivot about the longitudinal axis of the attachment rod 92 when the adjustment assembly 12 is manipulate by the operator to adjust the rotor assembly 14. In addition, bushings and devices of the like may be operably engaged between the attachment rod 92 and the housing 30 to allow the bottom frame 90 to freely rotate about the attachment rod 92 when the adjustment assembly 12 is manipulate by the operator during a raking operation.

Still referring to FIG. 5, the bottom frame 90 may include a bottom mount 94 that extends away from the bottom mount 94 and towards the top end 1E of the power rake 1. The bottom mount 94 may define a set of attachment openings 95 that extends entire through the bottom mount 94 relative to the transverse axis of the power rake 1. The bottom mount 94 may be configured to operably engage a force generating device of the adjustment assembly 12 with the bottom frame 90, which is described in more detail below.

Still referring to FIG. 5, the bottom frame 90 may also define tie down openings 96 to allow for adequate attachment position for tying down the power rake 1 to a vehicle, a trailer, or other suitable apparatus. In the illustrated embodiment, the tie down openings 96 may be defined proximate to the outermost edges of the bottom frame 90 to allow for ease of accessing the tie down openings 96. The bottom frame 90 also defines a front notch 98 that extends into the bottom frame 90 from a front end of the bottom frame 90. The purpose of the front notch 98 is described in more detail below.

Still referring to FIG. 5, the bottom pivot assembly 60B includes a lower linkage assembly 100. The lower linkage assembly 100 is operably engaged with the bottom frame 90 inside of the front notch 98. In the illustrated embodiment, the lower linkage assembly 100 is press-fitted with the bottom frame 90 inside of the front notch 98. In other exemplary embodiments, a lower linkage assembly may be operably engaged with a bottom frame in any suitable arrangement. In the illustrated embodiment, the lower linkage assembly 100 operably engages the bottom pivot assembly 60B of the adjustment assembly 12 with the rotor assembly 14 via a locking mechanism 102, which is described in more detail below. With this engagement, the lower linkage assembly 100 allows the adjustment assembly 12 to transition the rotor assembly 14 upwardly and downwardly by allowing the bottom pivot assembly 60B to pivot at the lower linkage assembly 100. In the illustrated embodiment, the lower linkage assembly 100 may also include a swiveling ball joint that allows the bottom pivot assembly 60B to swivel upwardly and downwardly when the adjustment assembly 12 is manipulating the height of the rotor assembly 14 for a desired depth of raking. Moreover, the lower linkage assembly 100 is opposite to the upper linkage assembly 80 relative the vertical axis "Z" of the housing 30 where the upper linkage assembly 80 is positioned above the lower linkage assembly 100.

Referring to FIGS. 4-5, the adjustment assembly 12 includes a height cylinder 110 that laterally adjusts the rotor assembly 14 upwardly and downwardly relative to the vertical axis "Z" of the housing 30. The height actuator 110 is operably connected to the tractor 2 where the height actuator 110 is operably controlled by an operator via a control system 5 provided on the tractor 2. In more particular, the first control lever 6 and the button 6A of the control system 5 operably controls the actuation of the height cylinder 110 to set a desired height for or a desired depth for the rotor assembly 14 during a raking operation. In the illustrated embodiment, a base mount 110A of height cylinder 110 is operably engaged with the upper mounting bracket 54 via a first locking mechanism 112. In the illustrated embodiment, a connector 112A of the first locking mechanism 112 may operably engage the base mount 110A of height cylinder 110 with the upper mounting bracket 54 via openings 55 defined by the upper mounting bracket 54. The connector 112A may be secured to the height cylinder 110 and the upper mounting bracket 54 via a nut 112B tightened to the threaded section of the connector 112A. During a raking operation, the base mount 110A of the height cylinder 110 may freely pivot about the longitudinal axis of the connector 112A when the adjustment assembly 12 laterally adjusts the rotor assembly 14 upwardly and downwardly.

Still referring to FIGS. 4-5, the height cylinder 110 may include a rod mount 110B disposed on a piston rod 111 of the height cylinder 110. The rod mount 110B may be disposed opposite to the base mount 110A on the height cylinder 110. The rod mount 110B may be operably engaged with the bottom mount 94 of the bottom fame 90 via a second locking mechanism 114. Similar to the first locking mechanism 112, a connector 114A of the second locking mechanism 114 may operably engage the rod mount 1106 of height cylinder 110 with the bottom mount 94 via attachment openings 95 defined by the bottom mount 94. The connector 114A may be secured to the height cylinder 110 and the bottom mount 94 via a nut 114B tightened to the threaded section of the connector 114A. During a raking operation, the rod mount 1106 of the height cylinder 110 may transition with the piston rod 111 while freely pivoting about the longitudinal axis of the connector 114A when the adjustment assembly 12 laterally adjusts the rotor assembly 14 upwardly and downwardly.

Referring to FIGS. 2 and 4, the adjustment assembly 12 may also include a swivel cylinder 120 that rotatably adjusts the rotor assembly 14 about the vertical axis "Z" of the housing 30 relative to the housing 30. The swivel actuator 120 may also be operably connected to the tractor 2 where the swivel actuator 120 is operably controlled by an operator via the control system 5 provided on the tractor 2. In more particular, the first control lever 6 with the button 6A of the control system 5 may operably control the actuation of the swivel actuator 120 to set a desired angle of the rotor assembly 14 during a raking operation. In the illustrated embodiment, a base mount 120A of swivel actuator 120 may be operably engaged with the lower mounting bracket 56 via a first locking mechanism 122. In the illustrated embodiment, a connector 122A of the first locking mechanism 122 may operably engage the base mount 120A of swivel actuator 120 with the lower mounting bracket 56 via openings 57 defined by the lower mounting bracket 56. The connector 122A may be secured to the swivel actuator 120 and the lower mounting bracket 56 via a nut 122B tightened to the threaded section of the connector 122A. During a raking operation, the base mount 120A of the swivel actuator 120 may freely swivel along and about the longitudinal axis of the connector 112A when the adjustment assembly 12 laterally adjusts the rotor assembly 14 upwardly and downwardly or rotatable adjusts the rotor assembly 14.

Still referring to 2 and 4, the swivel actuator 120 may include a rod mount 120B disposed on a piston rod 121 of the swivel actuator 120. The rod mount 120B may also be disposed opposite to the base mount 120A on the swivel actuator 120. The rod mount 120B is operably engaged with the rotor assembly 14 via a second locking mechanism 124. Similar to the first locking mechanism 122, a connector 124A of the second locking mechanism 124 may operably engage the rod mount 120B of swivel actuator 120 with the rotor assembly 14, which is described in more detail below. The connector 124A may be secured to the swivel actuator 120 and the rotor assembly 14 via a nut 124B tightened to the threaded section of the connector 124A. During a raking operation, the rod mount 1206 of the swivel actuator 120 may transition with the piston rod 121 while freely swiveling along and about the longitudinal axis of the connector 114A when the adjustment assembly 12 laterally adjusts the rotor assembly 14 upwardly and downwardly or rotatable adjusts the rotor assembly 14.

The rotor assembly 14 may include a rotor frame generally referred to at 130. Referring to FIG. 4, rotor frame 130 may include a longitudinal support beam 132 that has a first end 132A, an opposing second end 132B, and a longitudinal axis defined therebetween. Referring to FIG. 5, the rotor frame 130 may also include a vertical support beam 134 operably engaged with the longitudinal support beam 134. The vertical support beam 134 may include a top end 134A, an opposing bottom end 134B, and a longitudinal axis defined therebetween. In the illustrated embodiment, the bottom end 1346 of the vertical support beam 134 is operably engaged with a central point of the longitudinal support beam 132 that is defined between the first end 132A and the second end 1326 of the longitudinal support beam 132. In addition, the vertical support beam 134 is positioned orthogonally to longitudinal support beam 132 relative to the longitudinal axis of the longitudinal support beam 132.

Referring to FIG. 5, the rotor frame 130 also includes an upper hitch mount 136A that is positioned at the top end 134A of the vertical support beam 134. The upper hitch mount 136A may be configured to receive and house a portion of the mounting plate 72 and the upper linkage assembly 80 of the top pivot assembly 60A. In addition, the upper hitch mount 136A may define a set of attachment openings 1366 adapted to receive and house the locking mechanism 82 to operably engage the top pivot assembly 60A with the upper hitch mount 136A. The upper hitch mount 136A is also configured to allow the top pivot assembly 60A to freely move inside of the upper hitch mount 136A when the adjustment assembly 12 adjusts the rotor assembly 14 during a raking operation.

Still referring to FIG. 5, the rotor frame 130 also includes a first lower hitch mount 138A that is positioned on the longitudinal support beam 132 between the first end 132A and the second end 132B. The first lower hitch mount 138A may be configured to receive and house a portion of the bottom frame 90 and the lower linkage assembly 100 of the bottom pivot assembly 60B. In addition, the first lower hitch mount 138A may define a set of attachment openings 138B that is configured to receive and house the locking mechanism 102 to operably engage the bottom pivot assembly 60B with the lower hitch mount 138A. The first lower hitch mount 138A is also configured to allow the bottom pivot assembly 60B to freely move inside of the first lower hitch mount 138A when the adjustment assembly 12 adjusts the rotor assembly 14 during a raking operation.

Referring to FIG. 2, the rotor frame 130 also includes a second lower hitch mount 140A that is positioned on the longitudinal support beam 132 between the first lower hitch mount 138A and the second end 132B of the longitudinal support beam 132. The second lower hitch mount 140A may be configured to receive and house the rod mount 120B of the swivel cylinder 120. In addition, the second lower hitch mount 140A may define a set of attachment openings 140B that is configured to receive and house the locking mechanism 124 to operably engage the swivel cylinder 120 with the rotor frame 130. The second lower hitch mount 140A is also configured to allow the rod mount 120B of the swivel cylinder 120 to freely move inside of the second lower hitch mount 140A when the adjustment assembly 12 adjusts the rotor assembly 14 during a raking operation.

Referring to FIGS. 2 and 3, the rotor frame 130 also includes a first side panel 142A that is operably engaged with the first end 132A of the longitudinal support beam 132. Rotor frame 130 also includes an opposing second side panel 142B that is operably engaged with the second end 132B of the longitudinal support beam 132. In the illustrated embodiment, the first side panel 142A and the second side panel 142B are parallel to one another and are positioned orthogonally to the longitudinal support beam 132 relative to the longitudinal axis of said longitudinal support beam 132.

Referring to FIGS. 2-5, 8A-8B, 12A, and 13A the rotor assembly 14 includes a rotor or drum rake generally referred to at 150. The rotor 150 includes a first end 150A, an opposing second end 150B, and a longitudinal axis defined therebetween. The rotor 150 also includes a shaft 151A that extends laterally away from the second end 150B of the rotor 150 parallel to the longitudinal axis of the rotor 150. The rotor 150 also defines a chamber 151B that extends into the rotor 150 at the first end 150A and progresses towards the second end 150B. Such uses of the extensions 151A and the chamber 151B are described in more detail below. The rotor 150 also includes a circumferential wall 152 that extends between the first end 150A and the second end 150B.

In addition, rotor 150 includes a plurality of teeth 154 operably engaged with the rotor 150 which extend radially away from the circumferential wall 152 of the rotor 150. Each tooth of the plurality of teeth 154 is also removably engagable with the rotor 150 in order to replace at least one tooth of the plurality of teeth 154 for a desired reason (e.g., dull tooth, damaged tooth, etc.). The plurality of teeth 154 is also arranged in a randomized pattern to prevent against creating designs in the surface during a raking operation. In addition, each tooth of the plurality of teeth 154 may be formed of any suitable material for grading and resurfacing uneven terrain. In one exemplary embodiment, each tooth of a plurality of teeth on a rotor may be formed of at least one material. In other exemplary embodiment, each tooth of a plurality of teeth on a rotor may be formed of a metal material and a carbon material. In other exemplary embodiment, each tooth of a plurality of teeth on a rotor may be formed of a carbine compound.

Referring to FIG. 3, the rotor assembly 14 may include a hydraulic motor 156. A drive shaft of the hydraulic motor 156 may be operably engaged with the first end 150A of the rotor 150 inside of the chamber 151B. The hydraulic motor 156 may be powered by the hydraulic system 38 due to the hydraulic motor 156 is operably connected to the pump 38A via the first and second hydraulic lines 39A, 39B. In the illustrated embodiment, the hydraulic motor 156 may operably control the rotation of the rotor 150 about the longitudinal axis of the rotor 150 and the speed of rotor 150 during a raking operation. During a raking operation, an operator of the power rake 1 may control the rotation and the speed over the hydraulic motor 156 via the second control lever 7 and the first and second switches 7A, 7B of the control system 5 provided on the tractor 2. Such actuation of each of the second control lever 7, the first switch 7A, and the second switch 7B during a raking operation is described in more detail below.

Referring to FIGS. 2 and 4, the rotor assembly 14 may also include a support bracket 158 that is operably engaged with the second side panel 142B. The support bracket 158 includes a mounting wall 159 that is parallel to the longitudinal axis of the longitudinal support beam 132 and orthogonal to the second side panel 142B. The mounting wall 159 is configured to operably engage with a pillow block bearing 160. The pillow block bearing 160 is sized and configured to receive the shaft 151A of the rotor 150 to allow the rotor 150 to freely rotate when rotated by the hydraulic motor 156. Additionally, a protective device and/or shield may cover the bearing of the pillow block bearing 160 to prevent any dirt or debris from entering into the pillow block bearing 160 during a raking operation. The rotor 150 may also include a nut 161 that operably engages to the shaft 151A to maintain the position of the rotor 150 when the rotor 150 is being rotated during a raking operation. The nut 161 does not hinder the rotation and/or movement of the rotor 150 in any rotational direction and/or at any speed of rotation.

Figure 11A:
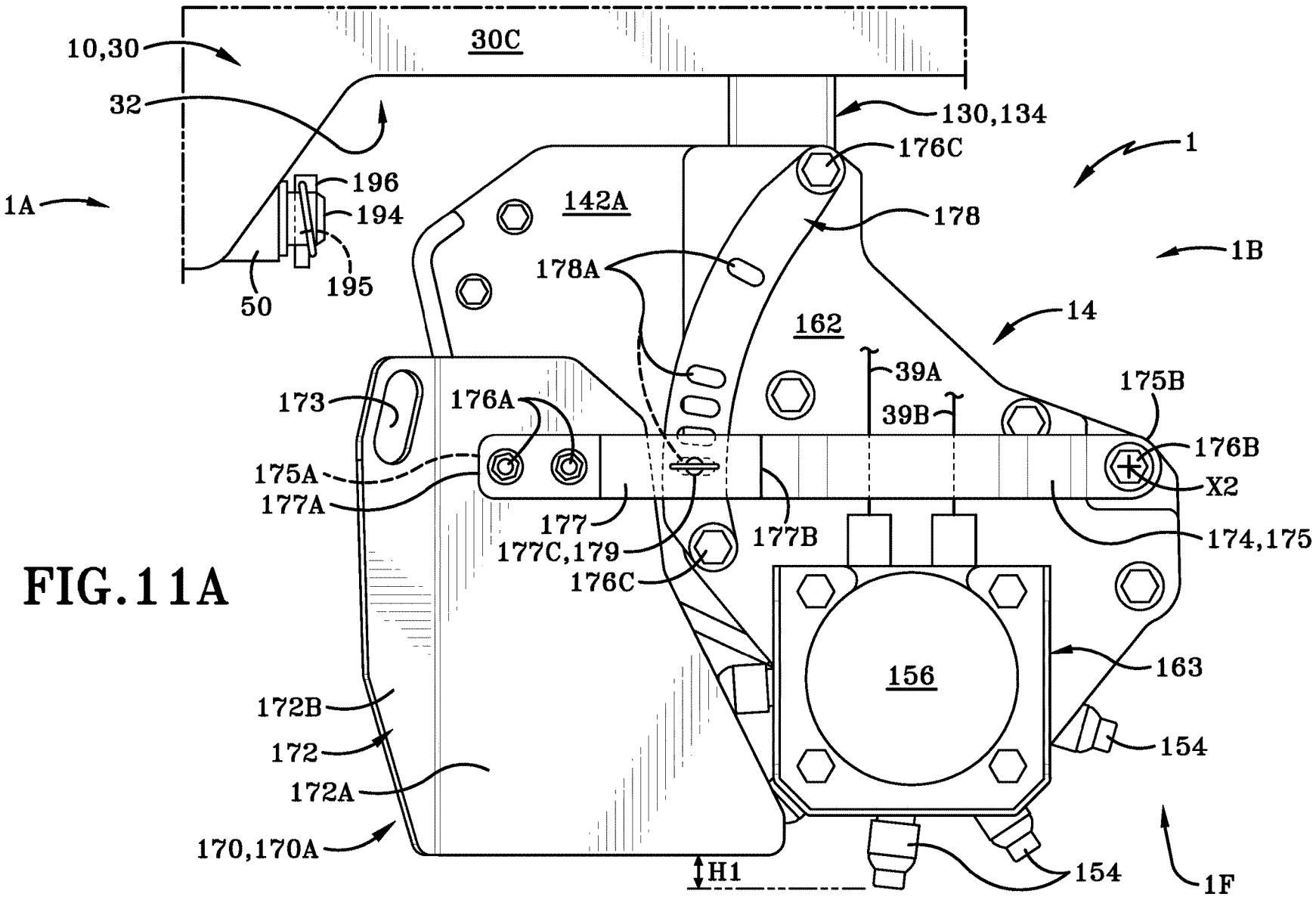
FIG. 11A (FIG. 11A) is a partial left side elevation view of the power rake; wherein a first wing assembly of the rotor assembly is provided in a closed position.
Figure 11B:
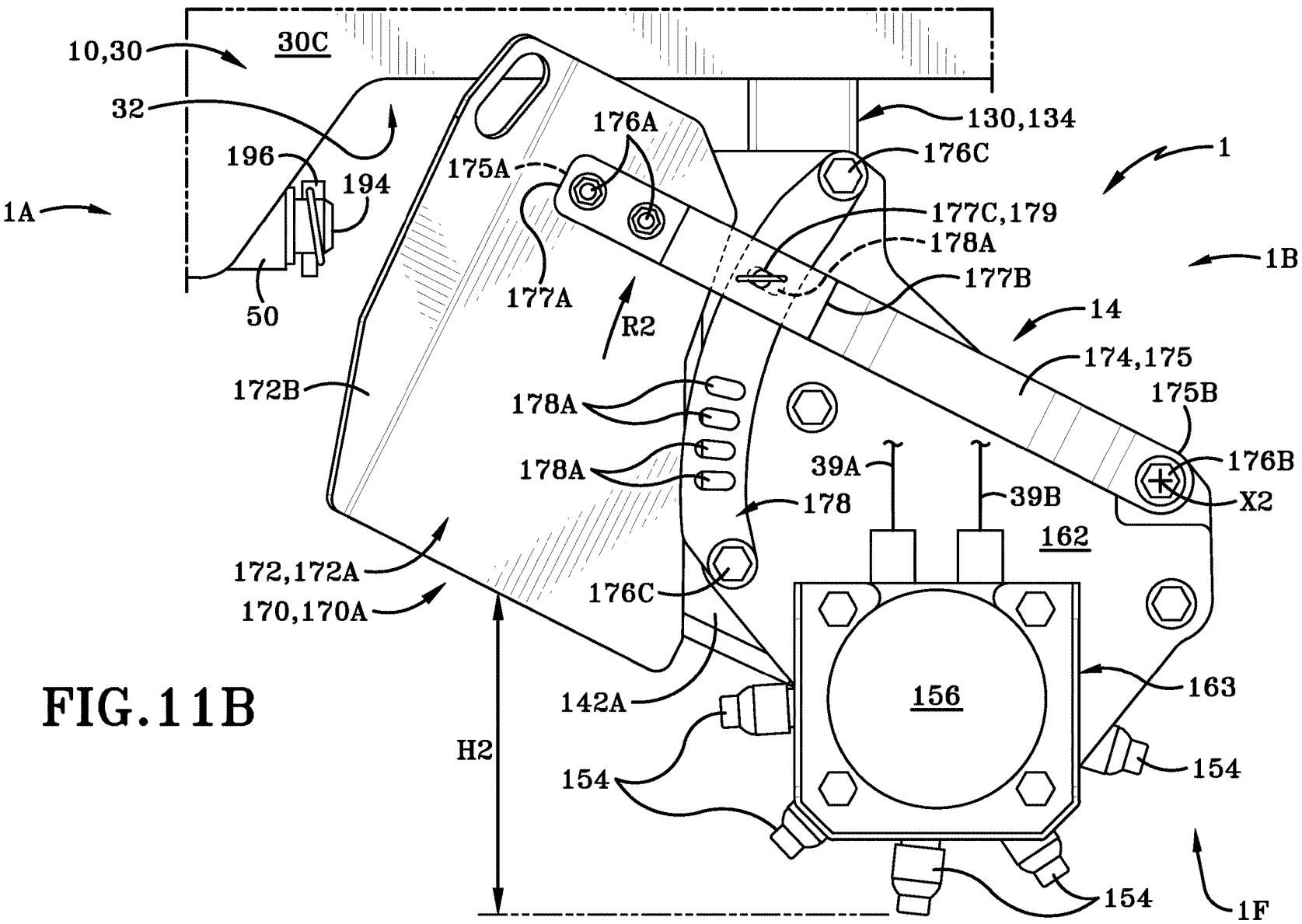
FIG. 11B (FIG. 11B) is a partial left side elevation view of the power rake similar to FIG. 11A, but the first wing assembly of the rotor assembly is provided in an opened position.

Referring to FIGS. 3 and 11A-11B, a motor mount 162 of the rotor assembly 14 may be operably engaged with an outer surface of the first side panel 142A that faces away from the longitudinal support beam 132. The motor mount 162 is configured to maintain the hydraulic motor 156 that powers the rotor 150 of the rotor assembly 14. Still referring to FIGS. 3 and 11A-11B, a motor guard 163 of the rotor assembly 14 may be operably engaged with an outer surface of the motor mount 162 that faces away from the longitudinal support beam 132. The motor guard 163 may be configured to shield and protect the hydraulic motor 156 that powers the rotor 150 of the rotor assembly 14 from debris thrown by said rotor 150 during a raking operation. Referring to FIG. 5, a guide plate 164 of the rotor assembly 14 may be operably engaged with an interior surface of the second side panel 142 that faces at the longitudinal support beam 132. The guide plate 164 of the rotor assembly 14 is positioned above the rotor 150 proximate to the second end 150B of the rotor 150. The guide plate 164 may provide guidance and control over the second end 150B of the rotor 150 to maintain the rotor 150 parallel to the ground surface "GS" during a raking operation.

While the motor 150 is operably engaged to the rotor frame 130, the motor 150 may be operably engaged to any suitable assembly and/or component of the power rake 1. In one exemplary embodiment, a motor of a rotor assembly of a power rake may be operably engaged to a component or member of a main frame of the power rake. In another exemplary embodiment, a motor of a rotor assembly of a power rake may be operably engaged to a component or device of an adjustment assembly of the power rake.

Referring to FIGS. 1-5, 8A-8B, and 10A-12B, the rotor assembly 14 may include at least one wing assembly 170 operably engaged with one of the first side panel 142A and the second side panel 142B. The at least one wing assembly 170 may include a first wing assembly 170A that is operably engaged with the first side panel 142A and an opposing second wing assembly 170B that is operably engaged with the second side panel 142B. The wing assemblies 170A, 170B are identical to one another and are engaged with the first side panel 142A and the second side panel 142B as mirror images of one another. Inasmuch as the wing assemblies 170A, 170B are identical, the following description will relate to the first wing assembly 170A. It should be understood, however, that the description of the first wing assembly 170A applies equally to the second wing assembly 170B except that the first wing assembly 170A is operably engaged with the first side panel 142A and the second wing assembly 170B is operably engaged with the second side panel 142B.

As illustrated in FIGS. 3 and 11A-11B, the first wing assembly 170A includes a wing 172. The wing 172 may include a first portion 172A and a second portion 172B that is bent relative to the first portion 172A. The second portion 172B of the wing 172 defines a through-hole or handle 173 that is configured to allow an operator of the power rake 1 to grasp and rotate the wing 172 upwardly and downwardly based on the raking operation, which is described in more detail below.

Still referring to FIGS. 3 and 11A-11B, the first wing assembly 170A also includes an attachment arm 174 that is operably engaged with the wing 172. The attachment arm 174 has a base member 175 that includes a front end 175A operably engaged with wing 172 (via at least one locking mechanism 176A) and an opposing rear end 175B operably engaged with the first side panel 142A (via at least one locking mechanism 176B). The base member 175 may have an offset portion that is defined between the front end 175A and the rear end 175B of the base member 175 and extends away from the first side panel 142 towards the left side 1C of the power rake 1. The offset portion is configured to allow the attachment arm 174 from interfering with the first and second hydraulic lines 39A, 39B when operably connected to the motor 156. The base member 175 also defines a through-hole 175C between the front end 175A and the rear end 175B proximate to the front end 175A. Such use of the through-hole 175C defined by the base member 175 is described in more detail below Still referring to FIGS. 3 and 11A-11B, the attachment arm 174 may also include an attachment member 177 that is operably engaged with the base member 175. In the illustrated embodiment, the attachment member 177 has a front end 177A that is operably engaged with the base member 175 (via the at least one locking mechanism 176A) and an opposing rear end 177B offset from the front end 177A. The attachment member 177 also defines a through-hole 177C at the rear end 177B of the attachment member 177. Such use of the through-hole 177C defined by the attachment member 177 is described in more detail below Still referring to FIGS. 3 and 11A-11B, the first wing assembly 170A also includes a selector plate 178 that is operably engaged with the first side panel 142A (via at least one locking mechanism 176C). The selector plate 178 is positioned between the base member 175 and the attachment member 177 of the attachment arm 174. In the illustrated embodiment, the selector plate 178 may define a set of selector openings 178A along the length of the selector plate 178. In the illustrated embodiment, the set of selector openings 178A defines a total of five selector openings in the selector plate 178. In other exemplary embodiments, any suitable number of selector openings may be defined along the length of a selector plate. The set of selector openings 178A defined by the selector plate 178 allows an operator of the power rake 1 to select a desired height for the wing 172 by rotating the wing 172 and the attachment arm 174 upwardly or downwardly about the at least one locking mechanism 176B positioned at the rear end 175B of the base member 175. In addition, a retaining member 179 may operably engage with the attachment arm 174 and the selector plate 178 at the through-hole 177C defined by the attachment member 177, the through-hole 175B defined by the base member 175, and one of the selector openings of the set of selector openings 178A defined by the selector plate 178 (see FIGS. 11A-11B).

Figure 6B:
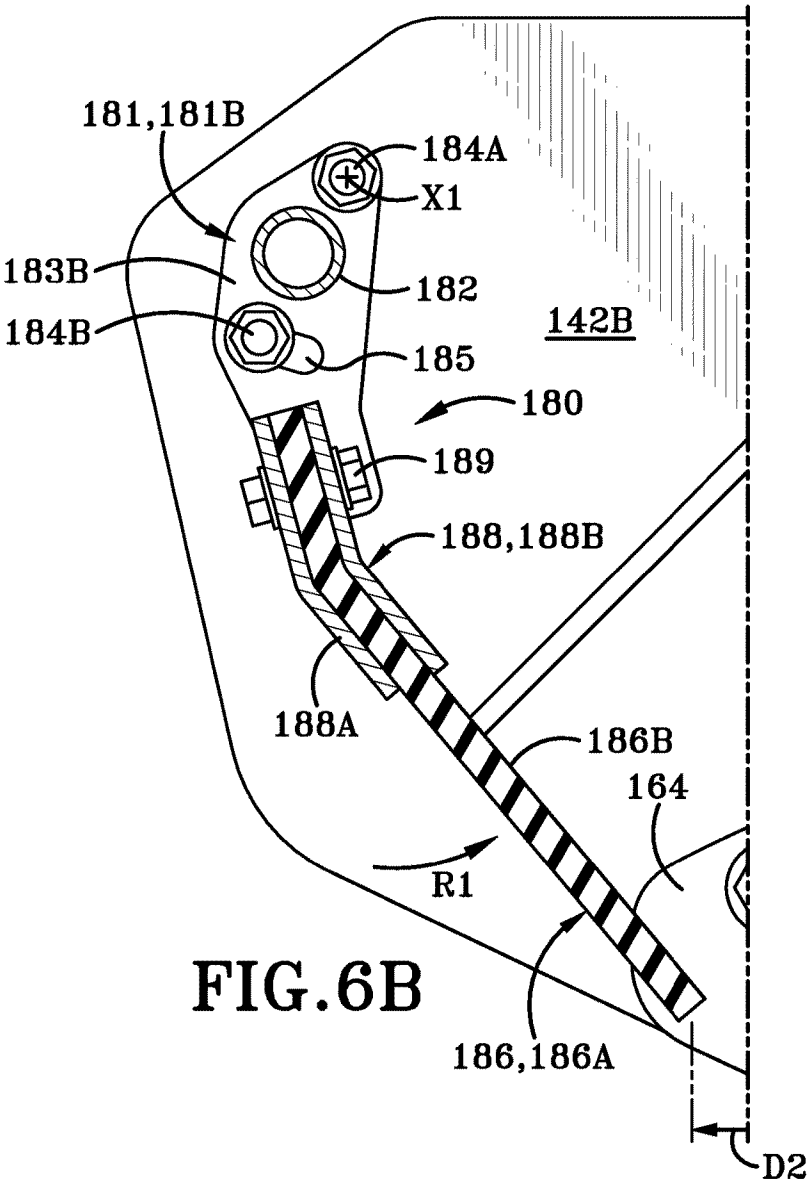
FIG. 6B (FIG. 6B) is an enlarged sectional view of a dirt containment flap assembly shown in FIG. 5; wherein the dirt containment flap assembly is provided in a closed position.

Referring to FIGS. 2-6B, the rotor assembly 14 may also include a dirt containment flap assembly 180. The dirt containment flap assembly 180 may include a frame 182 that is operably engaged with the first side panel 142A and the second side panel 142B. As illustrated in FIG. 4, the frame 182 may have a first cross member 183A that is positioned at a first end 182A of the frame 182 and operably engages with the first side panel 142A. The frame 182 may also have an opposing cross member 183B that is positioned at an opposing second end 182B of the frame 182 and operably engages with the second side panel 142B. As illustrated in FIG. 6A-6B, the second cross member 183B is rotatable about a first securement mechanism 184A that operably engages the second cross member 183B to the second side panel 142B. The second cross member 183B is rotatable about a first securement mechanism 184A when a second securement mechanism 184B is loosened inside of an oblong opening 185 defined by the second cross member 183B. Once the second securement mechanism 184B is tightened, the second cross member 183B is maintained at the desired position. While not illustrated herein, the first cross member 183A is identical to the second cross member 183B of the frame 182 as to rotating forwardly or rearwardly depending on the amount of dirt or material that is to be contained by the dirt containment flap assembly 180, which is described in more detail below.

Referring to FIGS. 5-6B, the dirt containment flap assembly 180 may include a resilient flap 186 that is formed of a resilient material (e.g., a rubber material). The flap 186 is operably engaged with the frame 182 via a clamping mechanism 188. The clamping mechanism 188 operably engages to a front surface 186A and an opposing rear surface 186B of the flap 186 where the flap 186 remains with the frame 182 during a raking operation. In the illustrated embodiment, a front belting 188A of the clamp mechanism 188 and a rear belting 188B of the clamping mechanism 188 operably engage to one another with the flap 186 being maintained between the front belting 188A and the rear belting 188B via attachment mechanisms 189 (e.g, fasteners and nuts). The rear belting 188B of the clamping mechanism 188 may also be operably engaged with the first cross member 183A and the second cross member 183B of the frame 182. In addition, the front belting 188A may be independent of the frame 182.

Referring to FIGS. 1-5 and 9A-10B, the front axle 16 may include a support bar 190. The support bar 190 may include a first end 190A, an opposing second end 190B, and a longitudinal axis defined therebetween. The support bar 190 also defines a first caster opening 191A at the first end 190A and a second caster opening 191B at the second end 190B. Each of the first caster opening 191A and the second caster opening 191B may be sized and configured to receive and house a caster 192 to support a wheel 193. The support bar 190 may be configured to have at least one wheel 193. In the illustrated embodiment, a first wheel 193A may be operably engaged with a first caster 192A inside of the first caster opening 191A. Additionally, a second wheel 193B may be operably engaged with a second caster 192B inside of the second caster opening 191B. The first and second wheels 193A, 193B of the front axle 16 may provide additional support and stability to the front end 1A of the power rake 1 during a raking operation.

Figure 10B:
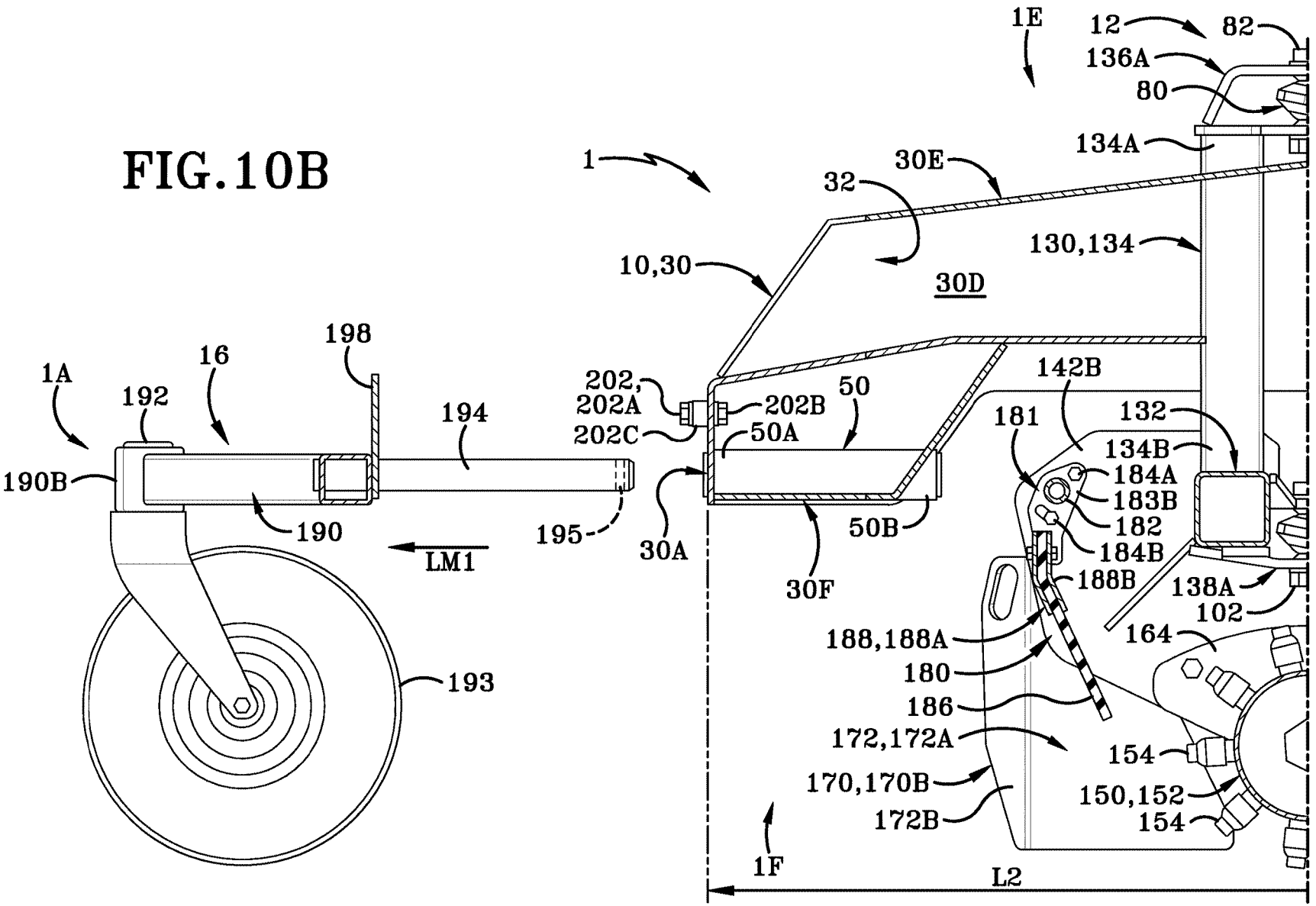
FIG. 10B (FIG. 10B) is a partial longitudinal section view of the power rake similar to FIG. 10A, but the front axle is removed from the main frame and remote from the main frame.

Referring to FIGS. 5 and 10A-10B, the front axle 16 may also include an attachment bar 194 that is operably engaged with the support bar 190 between the first end 190A and the second end 190B of the support bar 190. In the illustrated embodiment, the attachment bar 194 extends away from the support bar 190 and may be positioned orthogonal to the longitudinal axis of the support bar 190. As shown in FIGS. 5 and 10A, the attachment bar 194 is sized and configured to be received by the tubular member 50 of the main frame 10 where the tubular member 50 may maintain and hold the front axle 16. Based on this configuration, the front axle 16 may be independent of the main frame 10 where the front axle 16 is independently moveable (either linearly or rotatable) relative to the main frame 10 (see FIG. 9A), which is described in more detail below. The attachment bar 194 may also define a through-hole 195 at an opposing end away from the support bar 190. The through-hole 195 may be sized and configured to allow a hitch pin 196 to be operably engaged with the attachment bar 194 for maintaining the attachment bar 194 inside of the tubular member 50 during a raking operation. The inclusion of the hitch pin 195 may impede the linear movement of the attachment bar 194 relative to the main frame 10 (i.e., prevent attachment bar 194 from backing out of tubular member 50) yet not impede the rotational movement of the attachment bar 194 inside of the tubular member 50.

Referring to FIGS. 5 and 9A-10B, the front axle 16 may also include a vertical plate 198. The vertical plate 198 may be operably engaged with one or both of the support bar 190 and the attachment bar 194. The vertical plate 198 extends laterally away from support bar 190 relative to the vertical axis "Z" of the housing 30. In addition, the vertical plate 198 may define at least one oblong slot 200. In the illustrated embodiment, the vertical plate 198 may include a first oblong slot 200A and an opposing second oblong slot 200B where the first oblong slot 200A and the second oblong slot 200B are angle towards one another. Each oblong slot 200A, 200B may be sized and configured to receive a securement mechanism 202 that limit the movement or rotation of the front axle 16 during a raking operation (see FIG. 9A). Each securement mechanism 202 may include a connector 202A that operably engages the vertical plate 198 with the front wall 30A of housing 30 via the first and second oblong slots 200A, 200B and the first set of apertures 46A. The connector 202A in each securement mechanism 202 is maintained with the vertical plate 198 and the front wall 30A of the housing via a nut 202B. Each securement mechanism 202 may also include bushing 202C that is disposed about the connector 202A. The bushing 202C of each securement mechanism 202 may allow the front axle 16 to freely articulate and rotate about an axis of rotation "XF", defined by the attachment bar 194, when the ground surface "GS" is uneven or rough during a raking operation. In the illustrated embodiment, the front axle 16 is independently rotatable about the axis of rotation "XF", which is parallel to the longitudinal axis of the main frame 10.

Figure 9B:
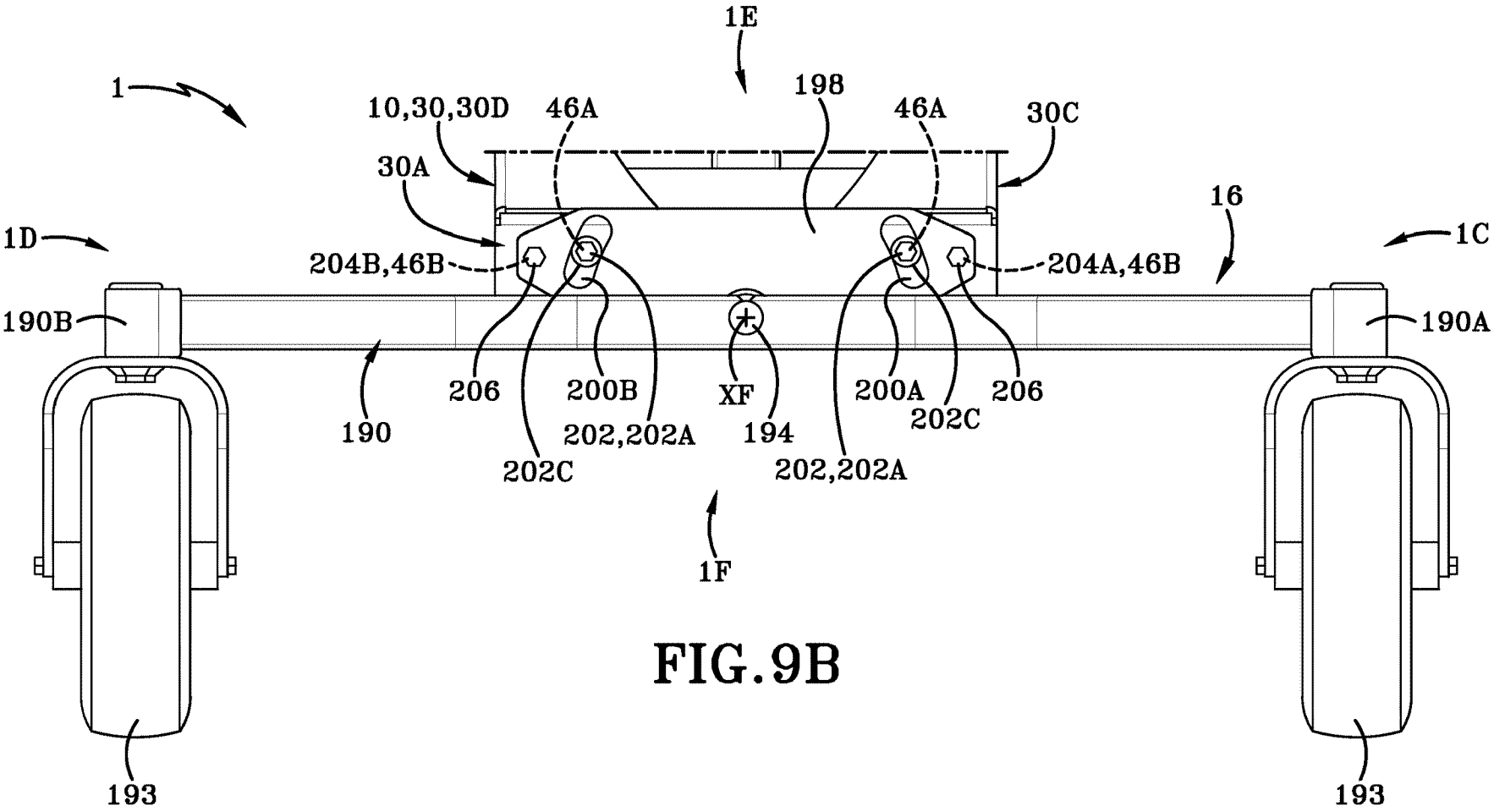
FIG. 9B (FIG. 9B) is a partial front elevation view of the front axle of the power rake similar to FIG. 9A, but the front axle remains fixed to the main frame.

Still referring to FIGS. 9A-9B, the vertical plate 198 may also define at least one fixed opening 204 adjacent to at least one oblong slot 200. In the illustrated embodiment, a first fixed opening 204A is defined by the vertical plate 198 adjacent to the first oblong slot 200A, and a second fixed opening 204B is defined by the vertical plate 198 adjacent to the second oblong slot 200B. The first fixed opening 204A and the second fixed opening 204B are defined outside of the first oblong slot 200A and the second oblong slot 200B where each of the first fixed opening 204A and the second fixed opening 204B is defined proximate to the outermost edge of the vertical plate 198. During a raking operation, an operator may desire to operably engage a locking mechanism 206 with the vertical plate 198 and the front wall 30A of the housing 30 inside of the first fixed opening 204A and the second fixed opening 204B and the second set of apertures 46B to prevent the front axle 16 from articulating and rotating about the axis of rotation "XF" (see FIG. 96). In other words, the inclusion of the locking mechanisms 206 maintains the front axle 16 parallel with the transverse axis of the main frame 10 during a raking operation. The locking mechanisms 206 described and illustrated herein may include a connector (e.g., a fastener or bolt) operably engaged with a nut with other spacers and/or washers to operably engage the vertical plate 198 with the front wall 30A.

Figure 7B:
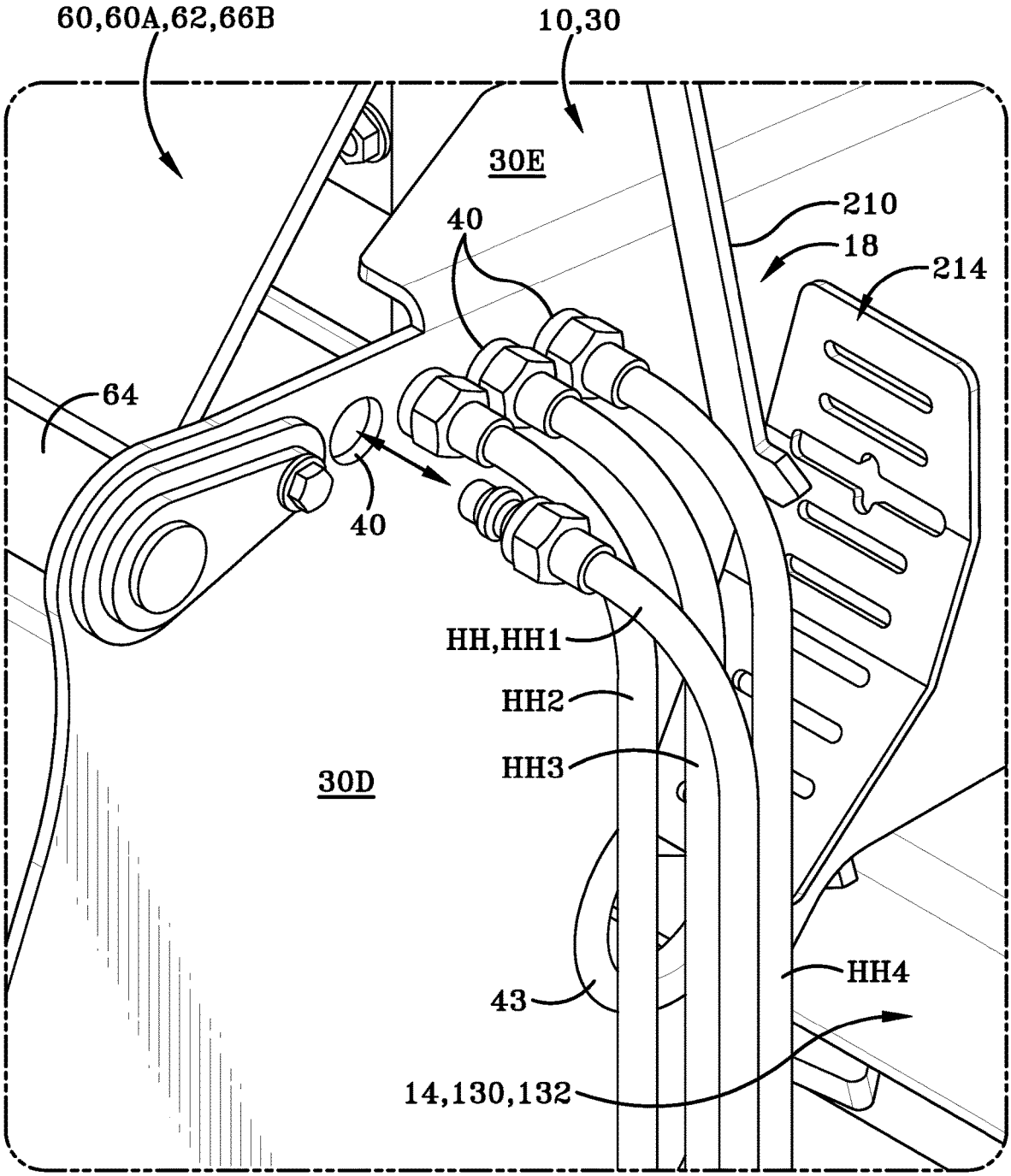
FIG. 7B (FIG. 7B) is a partial rear, top, right side isometric perspective view of the power rake similar to FIG. 7A, but the plurality of hydraulic hoses of the power rake are connected with the housing of the main frame via the plurality of securement hose.

Referring now to FIGS. 2, 4, 7A-7B, 12B, and 13B, the depth measurement assembly 18 includes a selecting arm 210 that is operably engaged with the adjustment assembly 12. As illustrated in FIGS. 4 and 5, the selecting arm 210 is operably engaged with a mounting bracket 212 provided on the second portion 66B of the upper frame 62 in the top pivot assembly 60A. The depth measurement assembly 18 also includes a depth indicator plate 214 that is operably engaged with the right wall 30D of the housing 30 (see FIGS. 2 and 7A-7B). Still referring to FIGS. 2 and 7A-7B, the depth indicator plate 214 defines a plurality of measurement slots 216 along the length of the depth indicator plate 214. Each measurement slot of the plurality of measurement slot 216 indicates or references a level of depth at which the roller 150 is below a ground surface "GS" (see FIG. 12B) or indicates a level of height at which the roller 150 is above the ground surface "GS" (see FIG. 13B). As illustrated in FIG. 7A-7B, the depth indicator plate 214 defines a neutral and/or level slot 217 marked with an upward facing arrow and a downward facing arrow. The level slot 217 signals to the operator of the power rake 1 that the power rake 1 is at the optimal height for attaching and detaching the power rake 1 with the tractor 2. When the rotor 150 is positioned at the height indicated by the level slot 217, the outermost end of each tooth of the plurality of teeth 154 may be positioned above the ground surface "GS" (see FIG. 1).

In addition, an operator of the power rake 1 may lower or raise the rotor assembly 14 by referencing to the depth measurement assembly 18 for a desired raking operation. In one example, the operator of the power rake 1 may raise the rotor assembly 14, via the control system 5 on the trailer 2, above the level slot 217 to elevate the rotor 150 above a ground surface "GS" (see FIGS. 13A and 13B). In the illustrated embodiment, the rotor 150 may be elevated from a height range from about zero inches up to about two inches above a ground surface "GS". Such raising of the rotor assembly 14 with the assistance of the depth measurement assembly 18 during a raking operation is described in more detail below. In another example, the operator of the power 1 may lower the rotor assembly 14, via the control system 5 on the trailer 2, below the level slot 217 to bury the rotor 150 into the ground surface "GS" (see FIGS. 12A and 12B). In the illustrated embodiment, the rotor 150 may be lowered to a depth range from about zero inches down to about six inches below a ground surface "GS". Such lowering of the rotor assembly 14 with the assistance of the depth measurement assembly 18 during a raking operation is described in more detail below.

Having now described the associated assemblies and components of the power rake 1, methods of using the associated assemblies and components of the power rake during raking operations are described below.

Prior to an operator performing a raking operation, the operator may operably engage the power rake 1 with the tractor 2 by operably engaging the attachment hitch arms 2D of the tractor 2 with the first hitch arm 44A and the second hitch arm 44B (see FIG. 1). Once the power rake 1 is connected to the tractor 2, the operator may then operably engage the plurality of hydraulic hoses "HH" of the power rake 1 to the mechanical power assembly 3 of the tractor 2. The hydraulic hoses "HH" that may operably connect to the mechanical power assembly 3 of the tractor 2 provides power and control over the height cylinder 110 and the swivel cylinder 120 for articulating and moving the rotor assembly 14. As illustrated in FIG. 1, a first hydraulic hose "HH1" and a second hydraulic hose "HH2" of the plurality of hydraulic hoses "HH" may be removed from the associated securement hose holes 40 (see FIGS. 7A-7B) and may be operably engaged with the mechanical power assembly 3 of the tractor 2 for operably controlling the actuation of the height cylinder 110. Similarly, a third hydraulic hose "HH3" and a fourth hydraulic hose "HH4" of the plurality of hydraulic hoses "HH" may be removed from the associated securement hose holes 40 (see FIGS. 7A-7B) and may be operably engaged with the mechanical power assembly 3 of the tractor 2 for operably controlling the actuation of the swivel cylinder 120. In addition, the operator may operably engage the PTO 2B of the tractor 2 with the power rake 1 for operably powering the pump 38B and the motor 156 of the power rake 1. The operator may also operably connect an electrical wire and/or connection "W" from the tractor 2 to the actuator 38C for operably controlling the rotation and speed of the pump 38C, which in turn controls the rotation and speed of the motor 156 operably engaged with the rotor 150.

Once the power rake 1 is operably engaged with the tractor 2 (see FIG. 1.), the operator may adjust and/or arrange associated assemblies and parts of the power rake 1 in particular configurations and/or orientations prior to performing a raking operation with said power rake 1. Such assemblies and parts that may be adjusted and/or arranged prior to or while performing a raking operation are provided in more detail below.

Figure 6A:
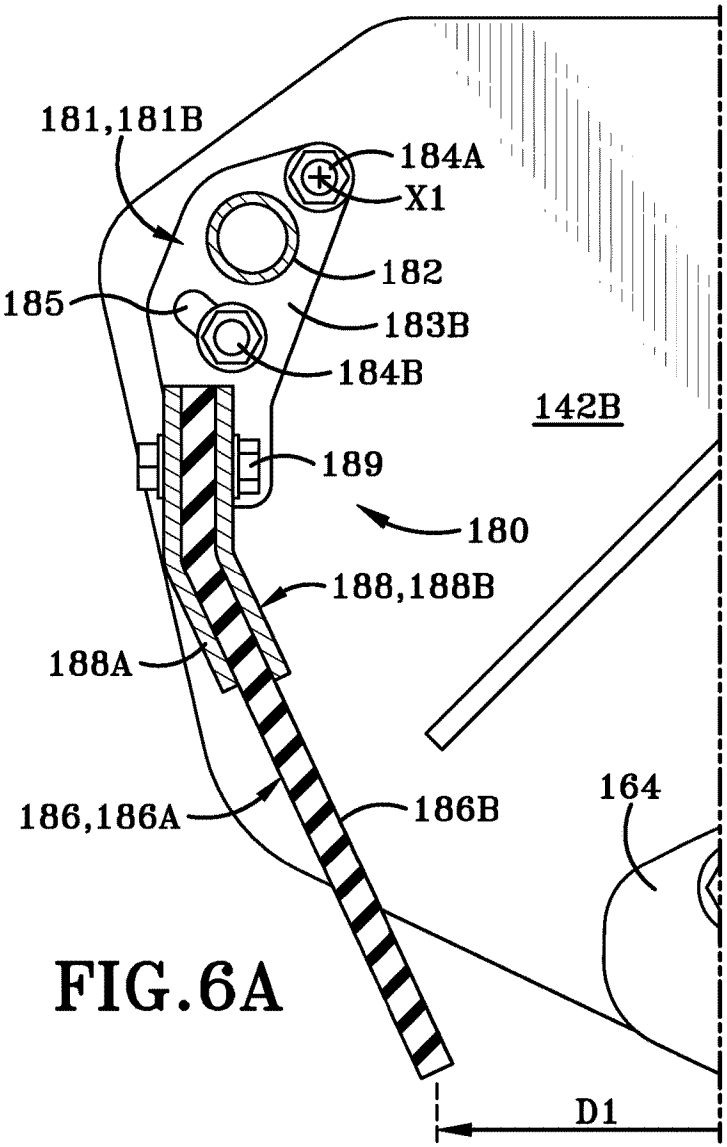
FIG. 6A (FIG. 6A) is an enlarged sectional view of a dirt containment flap assembly shown in FIG. 5; wherein the dirt containment flap assembly is provided in an opened position.

In one instance, the operator of the power rake 1 may adjust the dirt containment flap assembly 180 for containing a desired amount of loosened dirt and/or material inside of the rotor assembly 14 (see FIG. 6A-6B). As illustrated in FIG. 6A, the dirt containment flap assembly 180 is arranged in an open position. In this open position, the dirt containment flap assembly 180 is positioned in the most forward position allowed by the first and second cross members 183A, 183B of the frame 182. As illustrated in FIG. 6A, the resilient flap 184 of the dirt containment flap assembly 180 may be positioned at a first distance "D1" away from the rotor 150, which may allow the most dirt and/or material to escape outside of the rotor assembly 14 and the dirt containment flap assembly 180 during a raking operation (see FIG. 5). An operator may desire this open position of the dirt containment flap assembly 180 if the operator desires to level and/or resurface a ground surface "GS".

As illustrated in FIG. 6B, the dirt containment flap assembly 180 may also be arranged in a closed position. In this closed position, the dirt containment flap assembly 180 may be rotated about an axis of rotation "X1", as defined by the first securement mechanism 184A, from the most forward position to a most rearward position allowed by the first and second cross members 183A, 183B of the frame 182. The rotation of the dirt containment flap assembly 180 is denoted by an arrow labeled "R1" in FIG. 6B. In addition, the resilient flap 186 of the dirt containment flap assembly 180 may be positioned at a second distance "D2" away from the rotor 150, which may allow the most dirt and/or material to be contained inside of the rotor assembly 14 and the dirt containment flap assembly 180 during a raking operation (see FIG. 5). In the illustrated embodiment, the second distance "D2" is less than the first distance "D1." An operator may desire this open position of the dirt containment flap assembly 180 if the operator desires to carry and/or remove dirt and material from the raked area.

In other exemplary embodiments, an operator may also desire to arrange the dirt containment flap assembly 180 at any position between the open position (see FIG. 6A) and the closed position (FIG. 6B) based on a desired raking operation performed with the power rake 1.

In another instance, the operator may adjust the wing assemblies 170A, 170B for containing a desired amount of loosened dirt and/or material inside of the rotor assembly 14 (see FIG. 11A-11B). As illustrated in FIGS. 1-3, 5, and 11A, each wing assembly 170A, 170B is provided in a closed position. In this closed position, each wing 172 in each wing assembly 170A, 170B may be positioned in the most downward position allowed by the selector 178 via the retaining member 179. In this lowest position, the retaining member 179 is positioned inside of selector 178 at the lowest selector opening of the set of selector openings 178A defined by the selector 178. In this closed position, each wing 172 of the first and second wing assemblies 170A, 170B is positioned at a first height "H1" from the outermost tips of the plurality of the teeth 154 of the rotor 150. The first height "H1" defined at the closed position may prevent the escapement of most dirt and/or material outside of the rotor assembly 14 by containing most dirt and/or material inside of said rotor assembly 14 during a raking operation (see FIG. 11A). An operator may desire this closed position of each wing assembly 170A, 170B if the operator desires to carry and/or remove dirt and/or material from the raked area.

As illustrated in FIG. 11B, each wing assembly 170A, 170B is provided in an opened position. In this opened position, each wing 172 in each wing assembly 170A, 170B may be positioned in the most upward position allowed by the selector 178, which is the highest selector opening of the set of selector openings 178A defined by the selector 178. In this opened position, each wing 172 of the first and second wing assemblies 170A, 170B may be rotated upwardly away from the rotor 150 by the operator grasping the wing 172 inside of the through-hole 173 and rotating each wing 172 upwardly at the through-hole 173. The operator may rotate the wing 172 until the retaining member 179 is able to operably engage the attachment arm 174 with the selector 178 at the highest selector opening (see FIG. 11B). The wing 172 along with the attachment arm 174 may pivot about an axis of rotation "X2" defined by the locking mechanism 176B. The rotation of the wing 172 and the attachment arm 174 of each wing assembly 170A, 170B that is created by the operator is denoted by an arrow labeled "R2" in FIG. 11B. At this opened position, the wing 172 of the wing assemblies 170A, 170B is positioned at a second height "H2" that is measured from the outermost tips of the plurality of the teeth 154 of the rotor 150, which is greater than the first height "H1" illustrated in FIG. 11A. The second height "H2" defined at the opened position may allow most dirt and/or material to escape outside of the rotor assembly 14 during a raking operation (see FIG. 11B). An operator may desire this opened position of each wing assembly 170A, 170B if the operator desires to level and/or resurface a ground surface "GS".

In other exemplary embodiments, an operator may also desire to arrange the wing 172 in one or both of the first and second wing assemblies 170A, 170B at any position between the opened position (see FIG. 11B) and the closed position (see FIG. 11A) based on a desired raking operation performed with the power rake 1. In other words, an operator may rotate the wings 172 of the first and second wing assemblies 170A, 170B upwardly or downwardly and fix the wings 172 at a desired selector openings 178A on the selector 178 via the retaining member 179 of each wing assembly 170A, 170B.

In yet another instance, the operator may operably engage the front axle 16 to the main frame 10 where the front axle 16 is fixed to the main frame 10 and is restrained from freely rotating about the tubular member 50. As illustrated in FIG. 9B, the operator of the power rake 1 may fix the vertical plate 198 to the front wall 30A of the housing 30 with the locking mechanisms 206 via the retaining openings 204A, 204B defined by the vertical plate 198 and the through-holes 46B defined by the front wall 30A. Once the locking mechanisms 206 are operably engaged with the vertical plate 198 and the front wall 30A, the front axle 16 remains substantially parallel with the transverse axis of the main frame 10 during a raking operation.

In yet another instance, the operator may remove the front axle 16 from the main frame 10. As illustrated in FIG. 10, an operator may first remove the hitch pin 196 from through hole 195 such that the hitch pin 196 is remote from the attachment bar 194. Once the hitch pin 196 is removed, the operator may then exert a linear force directed away from the front wall 30A of the housing 30 until the attachment bar 194 is outside of the passageway of the tubular member 50 and remote from the housing 30. The linear force exerted on the front axle 16 from the operator is denoted by an arrow labeled "LM1" in FIG. 10B.

As illustrated in FIG. 10A-10B, an operator may desire to remove the front axle 16 away from the main frame 10 for various instances. In one instance, the operator may desire to remove the front axle 16 away from the main frame 10 to reduce the overall length and/or footprint of the power rake 1 during a raking operation (e.g., raking closer to a structure or obstruction). In another instance, the operator may desire to remove the front axle 16 away from the main frame 10 to reduce the overall length and/or footprint of the power rake 1 when transporting and/or hauling the power rake 1 between different locations. As illustrated in FIG. 10A, the power rake 1 has an overall length "L1" that measures from the rearmost end of the hitch frame 44 to the leading edge of the at least one wheel 193 of the front axle 16. As illustrated in FIG. 10B the power rake has a reduced length "L2" that measure from the rearmost end of the hitch frame 44 to the leading edge of the front wall 30A of the housing 30, which is less than the overall length "L1" illustrated in FIG. 10A. When the front axle 16 is removed from the main frame 10, length of the power rake 1 is reduced to about one foot less of the overall length.

Once the associated assemblies and parts have been adjusted and orientated to the operator's desire, the power rake 1 may be used for a raking operation. While the associated assemblies and parts have been adjusted and oriented prior to the power rake 1 performing a raking operation, the aforementioned assemblies and parts may be adjusted and orientated during the raking operation if desired by the operator.

Figure 12A:
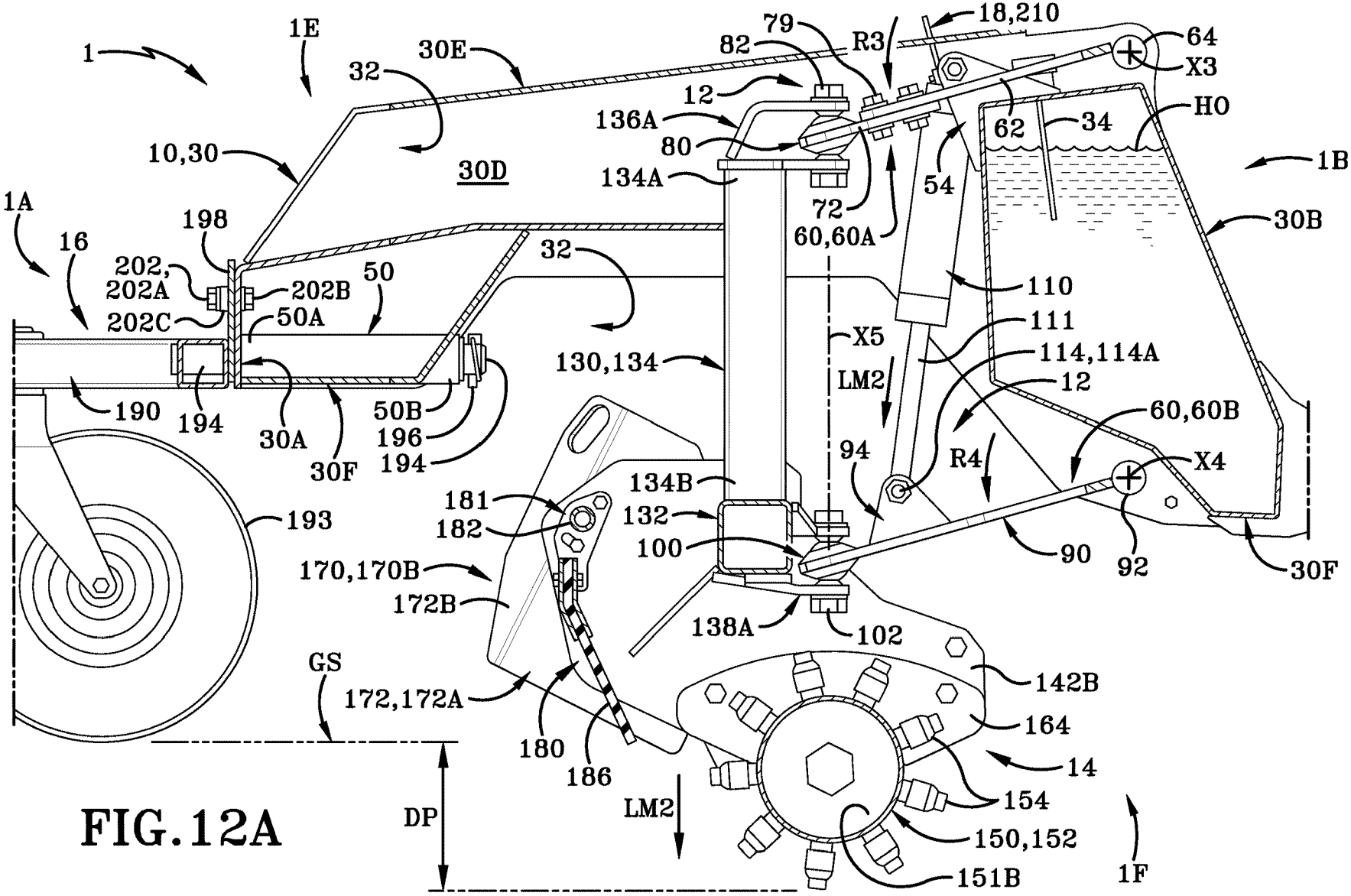
FIG. 12A (FIG. 12A) is a partial longitudinal section view of the power rake, wherein the adjustment assembly is lowering the rotor assembly beyond the main frame and into a ground surface.
Figure 12B:
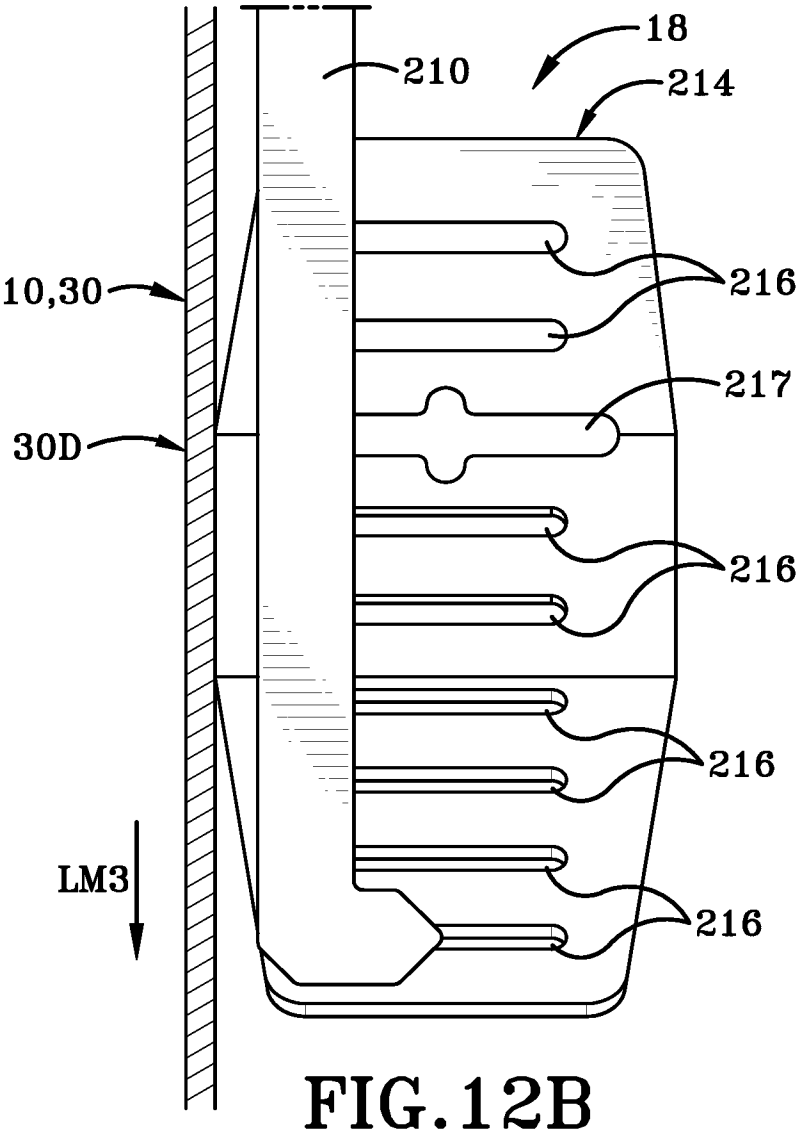
FIG. 12B (FIG. 12B) is a partial rear elevation view of the power rake, wherein a depth measurement assembly of the power rake indicates the rotor assembly is lowered to the lowest available position.

As illustrated in FIGS. 12A-12B, the operator of the power rake 1 may adjust the depth of the rotor assembly 14 via the control system 5 of the tractor 2. To lower the rotor assembly 14 towards and into the ground surface "GS", the operator may apply a first input on the first control lever 6 of the control system 5 to lower the rotor assembly 14. The first input applied by the operator on the first control lever 6 actuates the height cylinder 110, via the first and second hydraulic hoses "HH1", "HH2", where the piston rod 111 of the height cylinder 110 transitions downwardly towards the bottom end 1F of the power rake 1. As the piston rod 111 transitions downwardly, the piston rod 111 cooperatively pushes the pivot assembly 60 and the rotor assembly 14 towards and past the bottom end 30F of the housing 30. As illustrated in FIG. 12A, the top pivot assembly 60A rotates about an axis of rotation "X3" defined along the length of the attachment rod 64 when the height cylinder 110 is being actuated. The rotation of the top pivot assembly 60A is denoted by an arrow labeled "R3" shown in FIG. 12A. Similarly, the bottom pivot assembly 60B also rotates about an axis of rotation "X4" defined along the length of the attachment rod 92 when the height cylinder 110 is being actuated. The rotation of the bottom pivot assembly 60B is denoted by an arrow labeled "R4" shown in FIG. 12A As the pivot assembly 60 transitions downwardly, the rotor assembly 14 may also transition downwardly due to the linkage between the pivot assembly 60 and the rotor frame 130. The linear downward movement of the rotor assembly 14 is denoted by an arrow labeled "LM2." in FIG. 12A. As illustrated in FIG. 12A, the linkage between the upper linkage assembly 80 and the upper hitch mount 136A of the vertical support beam 134 allows the rotor assembly 14 to move linearly downwardly while the top pivot assembly 60A rotates about the axis of rotation "X3". Similarly, the linkage between the lower linkage assembly 100 and the lower hitch mount 138A of the longitudinal support beam 132 allows the rotor assembly 14 to move linearly downwardly while the bottom pivot assembly 60B rotates about the axis of rotation "X4". As such, the upper linkage assembly 80 and the lower linkage assembly 100 allows the adjustment assembly 12 to transitions the rotor assembly 14 downwardly while maintaining the rotor 150 substantially parallel to the ground surface "GS."

As the adjustment assembly 12 operably moves the rotor assembly 14 into the ground surface "GS," the operator may look to the depth measurement assembly 18 for referencing how deep the rotor 150 has been plunged into the ground surface "GS" during a raking operation. As illustrated in FIG. 12B, the selecting arm 210 may progress downwardly with the adjustment assembly 12 due to the selecting arm 210 being operably engaged with the top pivoting assembly 60A of the adjustment assembly 12 via the mounting bracket 212. The downward movement of the selecting arm 210 is denoted by an arrow labeled "LM3" in FIG. 12B. During the raking operation, the operator may continuously apply the first input on the first control lever 6 until the rotor 150 has reached a suitable depth into the ground surface "GS" as desired by the operator. As illustrated in FIG. 12A-12B, the rotor assembly 14 is adjusted to the lowest depth available for the power rake 1 since the selector arm 210 is pointing to the lowest measurement slot of the plurality of measurement slot 217. In the illustrated embodiment, the rotor assembly 14 of the power rake 1 may be plunged into the ground surface "GS" at a depth "DP" measured from the ground surface "GS" to an outermost tip of a tooth of the plurality of teeth 154. In one exemplary embodiment, a rotor assembly of a power rake provided herein may be plunged into a ground surface at a depth range between about zero inches to about six inches below the ground surface.

Figure 13B:
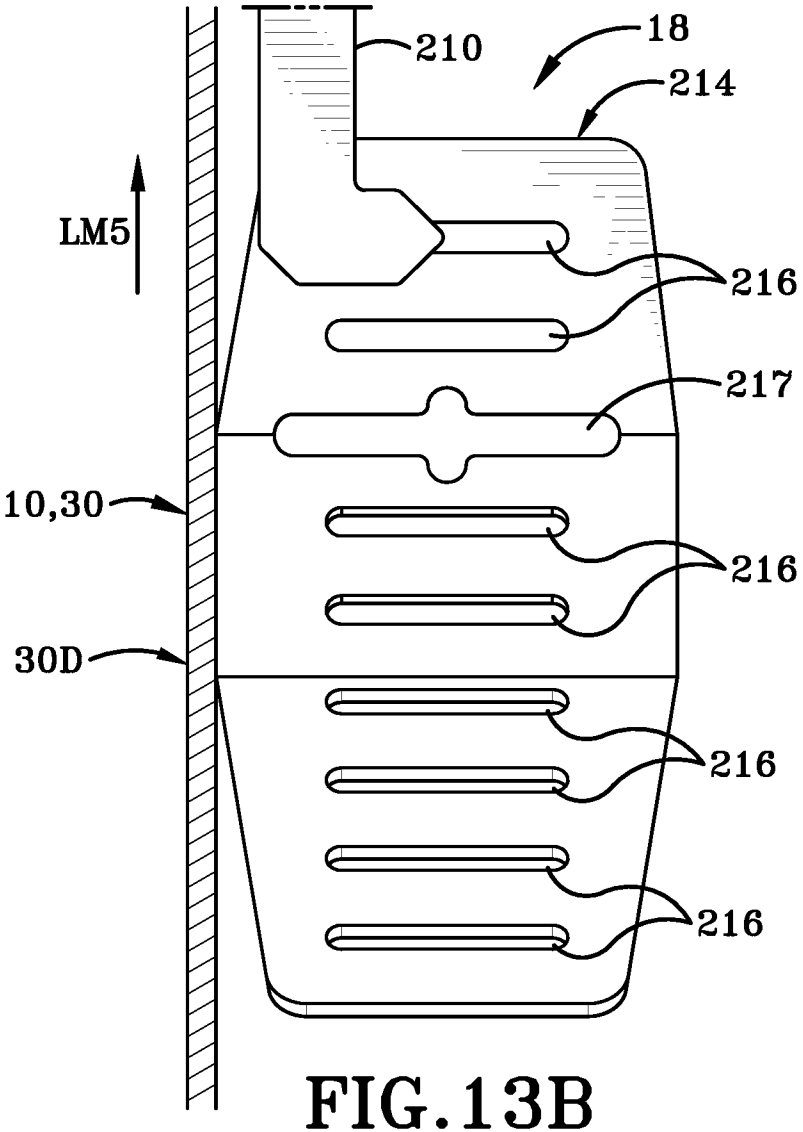
FIG. 13B (FIG. 13B) is a partial rear elevation view of the power rake, wherein the depth measurement assembly of the power rake indicates that the rotor assembly is raised to the highest available position.
Figure 13A:
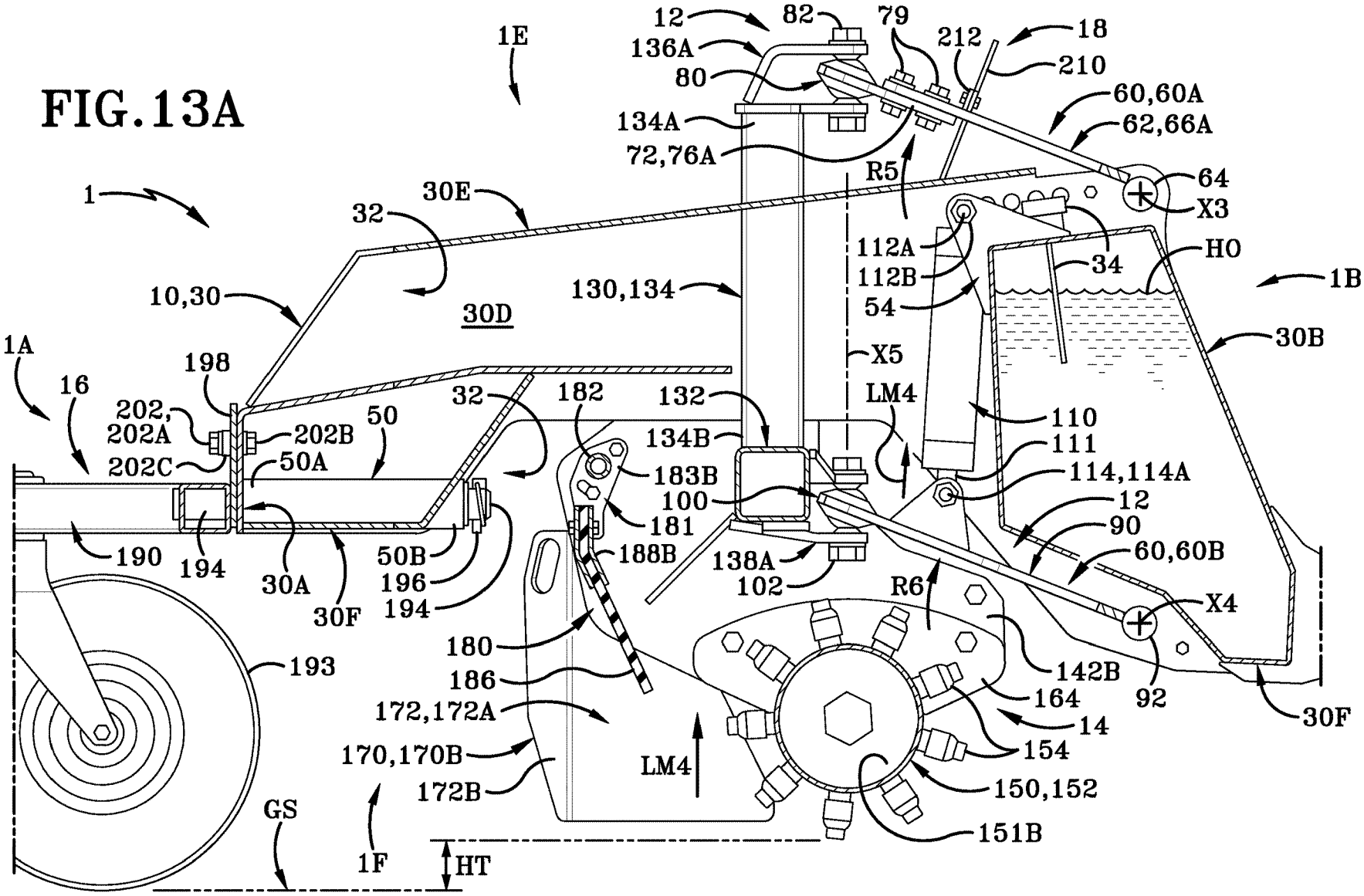
FIG. 13A (FIG. 13A) is a partial longitudinal section view of the power rake, wherein the adjustment assembly is lifting the rotor assembly into the main frame and away from the ground surface.

As illustrated in FIGS. 13A-13B, the operator of the power rake 1 may adjust the height of the rotor assembly 14 via the control system 5 of the tractor 2 opposite to adjusting the depth of the rotary assembly 14 via the control system 5 of the tractor 2 shown in FIGS. 12A-12B. To raise the rotor assembly 14 away from the ground surface "GS", the operator may apply a second input on the first control lever 6 of the control system 5 to raise the rotor assembly 14. The second input applied by the operator on the control system 5 actuates the height cylinder 110, via the first and second hydraulic hoses "HH1", "HH2", where the piston rod 111 of the height cylinder 110 transitions upwardly towards the top end 1E of the power rake 1. As the piston rod 111 transitions upwardly, the piston rod 111 cooperatively pulls the pivot assembly 60 and the rotor assembly 14 towards the top end 1E of the power rake 1. As illustrated in FIG. 13A, the top pivot assembly 60A rotates about the axis of rotation "X3" defined along the length of the attachment rod 64 when the height cylinder 110 is being actuated. The rotation of the top pivot assembly 60A is denoted by an arrow labeled "R5" shown in FIG. 13A. Similarly, the bottom pivot assembly 60B also rotates about the axis of rotation "X4" defined along the length of the attachment rod 92 when the height cylinder 110 is being actuated. The rotation of the bottom pivot assembly 60B is denoted by an arrow labeled "R6" shown in FIG. 13A.

As the pivot assembly 60 transition upwardly, the rotor assembly 14 may also transition linearly upwardly due to the linkage between the pivot assembly 60 and the rotor frame 130. The linear upward movement of the rotor assembly 14 is denoted by an arrow labeled "LM4." in FIG. 13A. As illustrated in FIG. 13A, the linkage between the upper linkage assembly 80 and the upper hitch mount 136A of the vertical support beam 134 allows the rotor assembly 14 to move linearly upwardly while the top pivot assembly 60A rotates about the axis of rotation "X3". Similarly, the linkage between the lower linkage assembly 100 and the lower hitch mount 138A of the longitudinal support beam 132 allows the rotor assembly 14 to move linearly upwardly while the bottom pivot assembly 60B rotates about the axis of rotation "X4". As such, the upper linkage assembly 80 and the lower linkage assembly 100 allows the adjustment assembly 12 to transitions the rotor assembly 14 upwardly while maintaining the rotor 150 substantially parallel to the ground surface "GS."

As the adjustment assembly 12 operably moves the rotor assembly 14 away from the ground surface "GS," the operator may look to the depth measurement assembly 18 for referencing how high the rotor 150 is elevated above the ground surface "GS" during a raking operation. As illustrated in FIG. 13B, the selecting arm 210 may progress upwardly with the adjustment assembly 12 due to the selecting arm 210 being operably engaged with the top pivoting assembly 60A of the adjustment assembly 12 via the mounting bracket 212. The upward movement of the selecting arm 210 is denoted by an arrow labeled "LM5" in FIG. 13B. During the raking operation, the operator may continuously apply the second input on the first control lever 6 until the rotor 150 has reached a suitable height above the ground surface "GS" as desired by the operator. As illustrated in FIGS. 13A-13B, the rotor assembly 14 is adjusted to the highest elevation available for the power rake 1 since the selector arm 210 is pointing to the highest measurement slot of the plurality of measurement slot 217. In the illustrated embodiment, the rotor assembly 14 of the power rake 1 may be elevated above the ground surface "GS" at a height "HT" measured from the ground surface "GS" to an outermost tip of a tooth of the plurality of teeth 154. In one exemplary embodiment, a rotor assembly of a power rake provided herein may be elevated above a ground surface at a height range between about zero inches to about two inches above the ground surface.

Figure 8A:
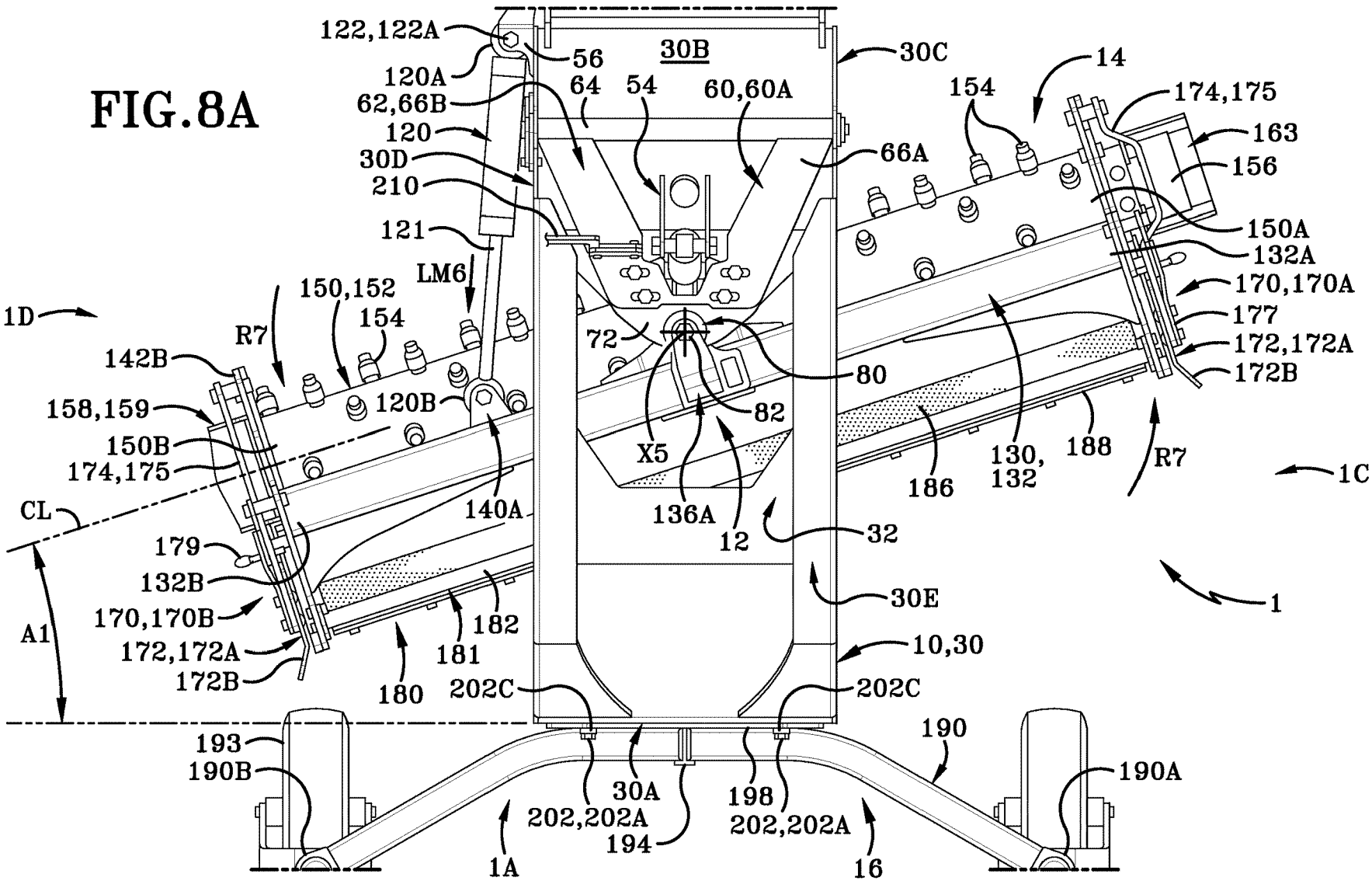
FIG. 8A (FIG. 8A) is a partial top plan view of the power rake, wherein an adjustment assembly is rotating a rotor assembly in a first direction.
Figure 8B:
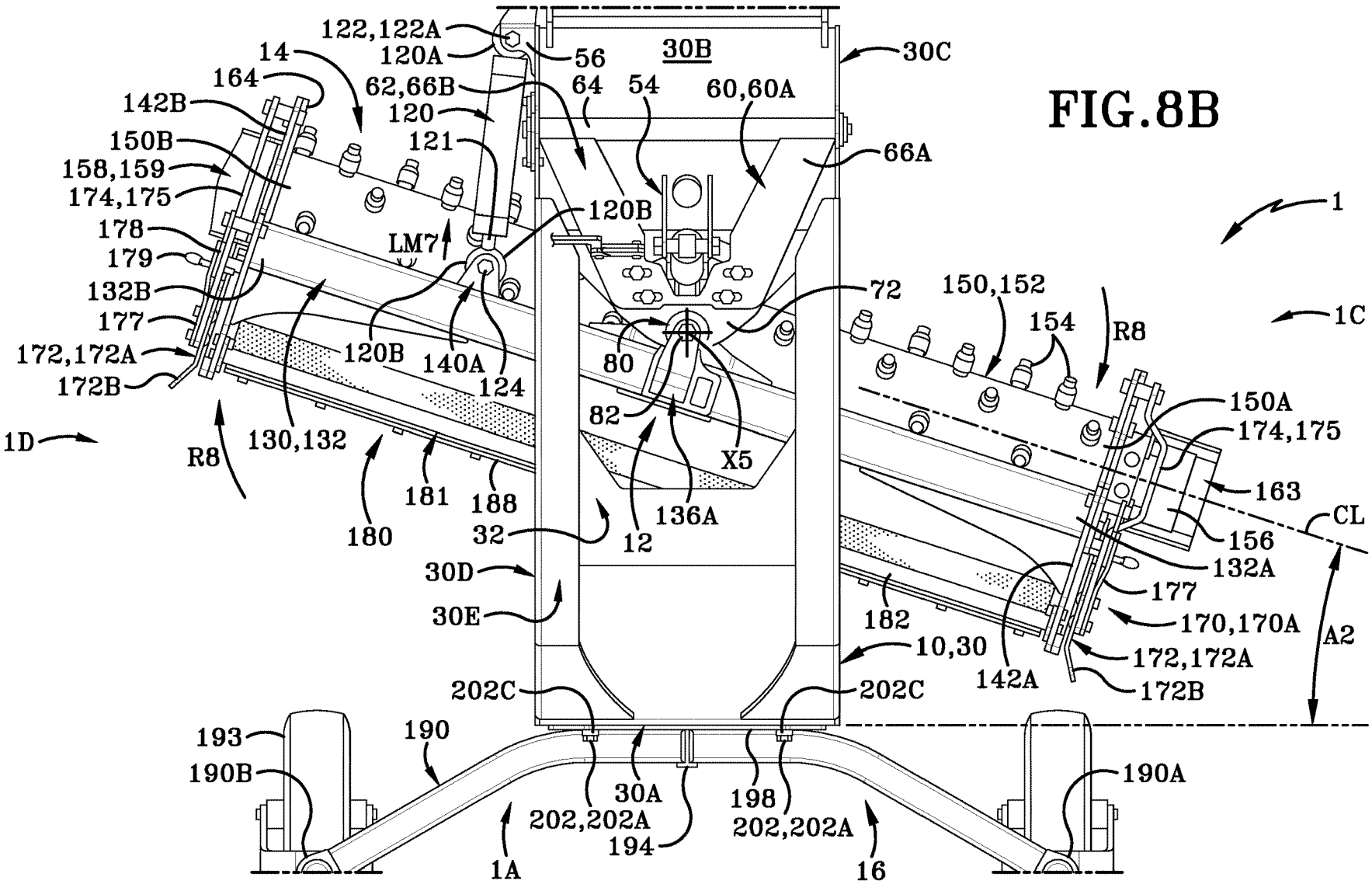
FIG. 8B (FIG. 8B) is a partial top plan view of the power rake similar to FIG. 8A, but the adjustment assembly is rotating the rotor assembly in an opposing second direction.

As illustrated in FIGS. 8A-8B, the operator of the power rake 1 may adjust the angle of the rotor assembly 14 via the control system 5 of the tractor 2. To rotate and/or swivel the rotor assembly 14 in a first, counterclockwise direction, the operator may apply a first input on the button 6A and the first control lever 6 of the control system 5. The first input applied by the operator on the button 6A and the first control lever 6 actuates the swivel cylinder 120, via the third and fourth hydraulic hoses "HH3", "HH4", where the piston rod 121 of the swivel cylinder 120 transitions forwardly towards the front end 1A of the power rake 1. The linear movement of the piston rod 121 is denoted by an arrow labeled "LM6" shown in FIG. 8A. As the piston rod 121 transitions forward, the piston rod 121 rotates and pushes the rotor assembly 14 in the first direction about the upper linkage assembly 80 and the lower linkage assembly 100 that defines an axis of rotation "X5". The axis of rotation "X5" extends from the upper linkage assembly 80 and to the lower linkage assembly 100. When the piston rod 121 transitions forward, the first end 132A of the longitudinal support beam 132 rotates towards the rear end 1B of the power rake 1 and the second end 132B of the longitudinal support beam 132 rotates towards the right wall 30D of the housing 30. The rotation of the of the longitudinal support beam 132 is denoted by an arrows labeled "R7" in FIG. 8A.

As the adjustment assembly 12 operably rotates the rotor assembly 14 in the first direction via the swivel assembly 120, the operator may continuously apply the first input on the button 6A and the first control lever 6 until the rotor 150 has reached a suitable angle as desired by the operator. As illustrated in FIG. 8A, the rotor assembly 14 is rotated to the greatest degree when rotating the rotor assembly 14 in the first direction. In the illustrated embodiment, a centerline "CL" of the rotor 150 of the rotor assembly 14 may be rotated at a first angle "A1" measured relative to the front wall 30A of the housing 30. In one exemplary embodiment, a rotor assembly of a power rake provided herein may be rotated in a first direction between an angle range of about zero degrees up to eighteen degrees relative to a front wall of a housing.

To rotate and/or swivel the rotor assembly 14 in a second, clockwise direction, the operator may apply a second input on the button 6A and the first control lever 6 of the control system 5 to rotate the rotor assembly 14. The second input applied by the operator on the button 6A and the first control lever 6 actuates the swivel cylinder 120, via the third and fourth hydraulic hoses "HH3", "HH4", where the piston rod 121 of the swivel cylinder 120 transitions backwards towards the rear end 1B of the power rake 1. The linear movement of the piston rod 121 is denoted by an arrow labeled "LM7" shown in FIG. 8B. As the piston rod 121 transitions backwards, the piston rod 121 rotates and pulls the rotor assembly 14 in the second direction about the upper linkage assembly 80 and the lower linkage assembly 100 that defines the axis of rotation "X5". When the piston rod 121 transitions backwards, the first end 132A of the longitudinal support beam 132 rotates towards the left wall 30C of the housing and the second end 132B of the longitudinal support beam 132 rotates towards the rear end 1B of the power rake 1. The rotation of the of the longitudinal support beam 132 is denoted by an arrows labeled "R8" in FIG. 8B.

As the adjustment assembly 12 operably rotates the rotor assembly 14 in the second direction via the swivel assembly 120, the operator may continuously apply the second input on the button 6A and the first control lever 6 until the rotor 150 has reached a suitable angle as desired by the operator. As illustrated in FIG. 8B, the rotor assembly 14 is rotated to greatest degree when rotating the rotor assembly 14 in the second direction. In the illustrated embodiment, the centerline "CL" of the rotor 150 of the rotor assembly 14 may be rotate at a second angle "A2" measured relative to the front wall 30A of the housing 30. In one exemplary embodiment, a rotor assembly of a power rake provided herein may be rotated in a second direction between an angle range of about zero degrees up to eighteen degrees relative to a front wall of a housing.

During a raking operation, the operator may vary the speed and the rotation of the rotor 150 of the rotor assembly 150 via one of the first switch 7A and second switch 7B along with the second control lever 7 of the control system 5. To vary the speed of the rotor 150, the operator may apply a first input on the first switch 7A of the second control lever 7 of the control system 5. The first input on the first switch 7A of the second control lever 7 varies the amount of hydraulic force applied to the motor 156 of the rotor assembly 14 by the hydraulic pump 38B operably controlled by the actuator 38C. The operator may apply the first input on the first switch 7A of the second control lever 7 until the rotor 150 is rotating at the desired speed. To vary the direction of the rotor 150, the operator may apply a second input on the second switch 7B of the second control lever 7. The second input on the second switch 7B of the second control lever 7 varies the direction of force applied to the motor 156 of the rotor assembly 14 by the hydraulic pump 38B operably controlled by the actuator 38C. The operator may also apply a third input on the second switch 7B of the second control lever 7 until the rotor 150 is rotating in a different direction as compared to the second input on the second switch 7B of the second control lever 7.

The variable controlling of the rotational speed and rotational direction of the rotor 150 is considered advantageous at least because the power rake 1 is able to grade or resurface different types of terrain while traveling forward or backwards along the terrain. In one instance, the operator of the power rake 1 may set the rotational speed of the rotor 150 at a low speed when the power rake 1 is grading or resurfacing a hard and/or compact terrain (e.g., stone, clay dirt, etc.). In another instance, the operator of the power rake 1 may set the rotational speed of the rotor 150 at a higher speed when the power rake 1 is grading or resurfacing a soft and/or loose terrain (e.g., fine dirt, sand, mulch, etc.). In yet another instance, the operator of the power rake 1 may set the rotational direction of the rotor 150 (between clockwise or counterclockwise) depending on whether the power rake 1 and the tractor 2 are grading or resurfacing the terrain in a forward direction or in a reverse direction.

Figure 14B:
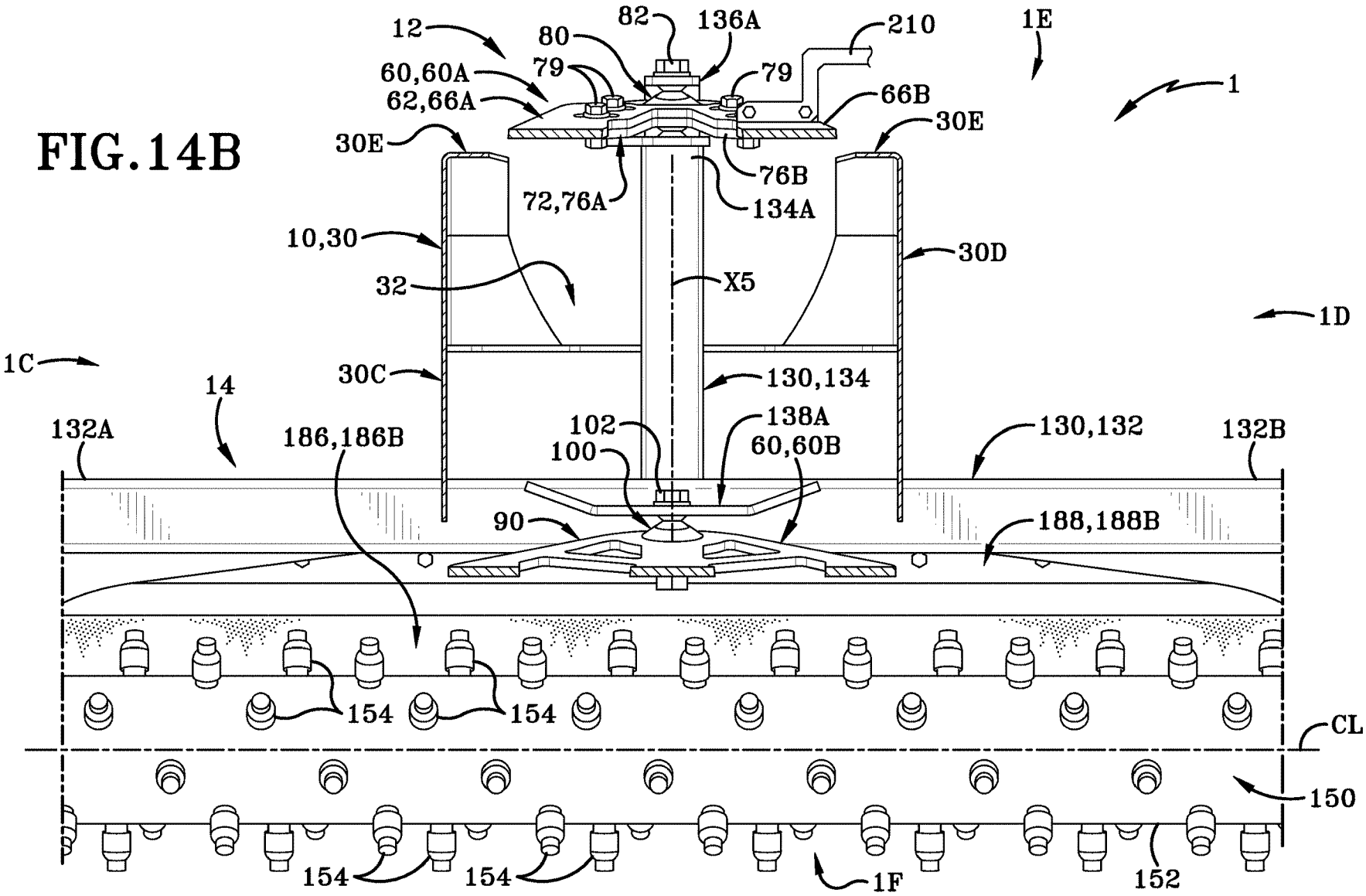
FIG. 14B (FIG. 14B) is partial rear sectional view of the power rake, wherein a vertical support beam of the rotor assembly is parallel to an axis of rotation defined between an upper linkage assembly and a lower linkage assembly of the adjustment assembly in the upright, non-pivoted position.
Figure 15B:
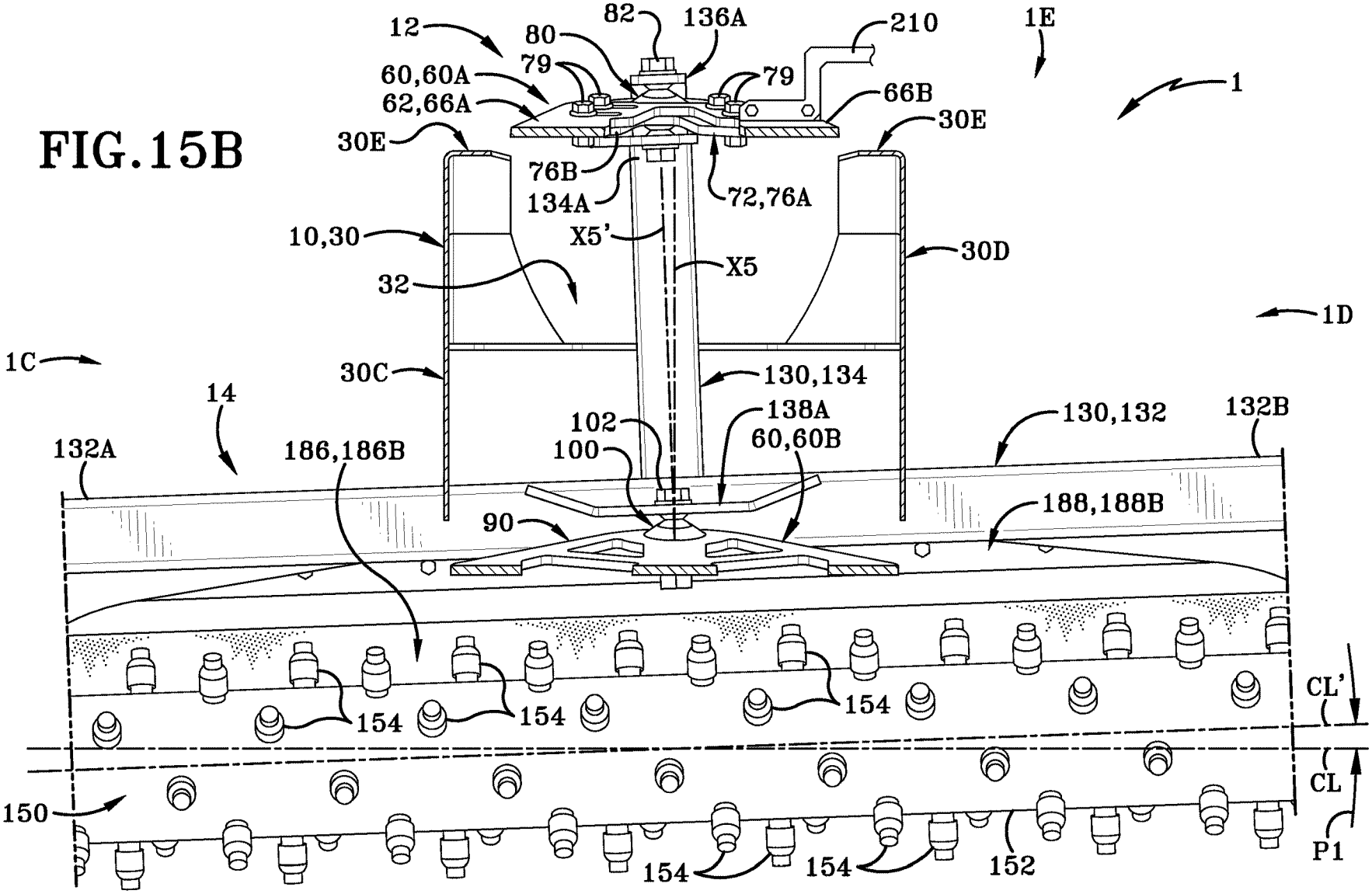
FIG. 15B (FIG. 15B) is partial rear sectional view of the power rake, wherein the vertical support beam of the rotor assembly is rotated to an angle relative to the axis of rotation defined between the upper linkage assembly and the lower linkage assembly of the adjustment assembly in the angled, pivoted position.

Referring now to FIGS. 14A-15B, the rotor assembly 14 may be pivoted and/or tilted by manipulating the pivot assembly 60. In the illustrated embodiment, the rotor assembly 14 may be pivoted by adjusting the top pivot assembly 60A where the upper frame 62 and the mounting plate 72 are offset to one another to pivot the rotor 150 about a transverse axis of the rotor 150. The pivoting of the rotor assembly 14 illustrated in FIGS. 15A and 15B is considered advantageous at least because it allows an operator of the power rake 1 to install and/or create swales and/or runoff surfaces while using the power rake 1. As such, an operator does not need to use additional tools and/or devices to install a swale or runoff surface.

As illustrated in FIG. 14B, the rotor assembly 14 is provided in an upright, non-pivoted position where the vertical support beam 134 is parallel with the left wall 30C and the right wall 30D of the housing 30. The centerline "CL" of the rotor 150 is also orthogonal to the left wall 30C and the right wall 30D of the housing 30 when the rotor assembly 14 is provided in the upright, non-pivoted position. In this upright, non-pivoted position, the vertical support beam 134 of the rotor assembly 14 is parallel with the axis of rotation "X5" defined between the upper linkage assembly 80 and the lower linkage assembly 100. In addition, the upper linkage assembly 80 and the lower linkage assembly 100 are aligned with the longitudinal axis "X" of the housing 30. Moreover, the adjustable securement mechanisms 79 are provided in a central location within each of the first set of openings 68 defined by the upper frame 62 and the second set of openings 78 defined by the mounting plate 72.

As illustrated in FIG. 15A-15B, the rotor assembly 14 is pivoted at a first angle "P1" where the upper frame 62 and the mounting plate 72 are offset to one another. In order to pivot the rotor assembly 14 at the first angle "P1", the operator may lift the rotor assembly 14 away from the bottom end 1F of the power rake 1 and towards the top end 1E of the power rake 1 (see FIG. 13A for lifting operation). Once lifted, the operator of the power rake 1 may loosen the adjustable securement mechanisms 79 enough that that upper frame 62 and the mounting plate 72 are laterally moveable while still being operably engaged with the upper frame 62 and the mounting plate 72.

Once the adjustable securement mechanisms 79 are loosened, the operator may then place a sturdy object (e.g, a piece of wood or a similar type of object) or structure underneath the desired end of the rotor 150 (either the first end 150A or the second end 150B) to acquire the first angle "P1." In the illustrated embodiment, the sturdy object would be positioned underneath the second end 150B of the rotor 150 to acquire the first angle "P1" illustrated in FIGS. 15A-15B. Once the sturdy object is placed, the operator may then lower the rotor assembly 14 towards the bottom end 1E of the power rake (see FIG. 12A for lowering operation). The operator of the power rake 1 may cease the lowering operation of the rotor assembly 14 when the first end 150A of the rotor 150 contacts the ground surface "GS". During this lowering operation, the mounting plate 72 laterally moves towards the left side 1C of the power rake 1 and away from the upper frame 62 to pivot the rotor assembly 14 at the first angle "P1". The lateral movement of the mounting plate 72 is denoted by arrows labeled "LM6" in FIG. 15A. Alternatively, the operator of the power rake 1 may also manually pivot the rotor assembly 14 to acquire the first angle "P1" if a sturdy object and/or structure is not available. Once the first angle "P1" is acquired, the operator may then tighten the adjustable securement mechanisms 79 to maintain the first angle "P1" due to the offset of the upper frame 52 and the mounting plate 62.

As illustrated in FIG. 15B, the rotor assembly 14 is provided in the angled, pivoted position where the vertical support beam 134, along with rotor assembly 14, is pivoted at the first angle "P1" relative to the left wall 30C and the right wall 30D of the housing 30. In this angled, pivoted position, the vertical support beam 134, along with component attached components of the rotor assembly 14, is pivoted at the first angle "P1" relative to the axis of rotation "X5" defined between the upper linkage assembly 80 and the lower linkage assembly 100. In addition, the upper linkage assembly 80 and the lower linkage assembly 100 are offset with the longitudinal axis "X" of the housing 30 and define an angled axis of rotation "X5" shown in FIG. 15B. As such, the angled axis of rotation "X5" is pivoted at the first angle "P1" relative to the original axis of rotation "X5" described previously. In the angled, pivoted position, the rotor 150 also defines an angled centerline "CL", which is angled relative to the non-pivoted centerline "CL" of the rotor 150 at the first angle "P1". Moreover, the adjustable securement mechanisms 79 are provided in a translated position proximate to the left wall 30C of the housing 30 in the first set of openings 68 in the upper frame 62 (see FIG. 15B). In this configuration, an operator may create or install swales or runoff surfaces with the power rake 1.

While not illustrated herein, the mounting frame 72 may also be laterally moved towards the right wall 30D of the housing 30 to pivot the rotor assembly 14 at a different angle opposite to the first angle "P1" illustrated herein. The methods and procedures of pivoting the rotor assembly 14 at an angle opposite to the first angle "P1" are substantially similar to the methods and procedures of pivoting the rotor assembly 14 at the first angle "P1."

While not illustrated herein, the operator may also laterally offset the mounting plate 72 forwardly or rearwardly due to the second set of openings 78 defined by the mounting plate 72. In one instance, the operator may offset the mounting plate 72 forwardly relative to the upper frame 52 to angle the rotor assembly 14 downwardly relative to the axis of rotation "X5". In another instance, the operator may offset the mounting plate 72 rearwardly relative to the upper frame 52 to angle the rotor assembly 14 upwardly relative to the axis of rotation "X5" defined between the upper linkage assembly 80 and the lower linkage assembly 100.

Figure 16:
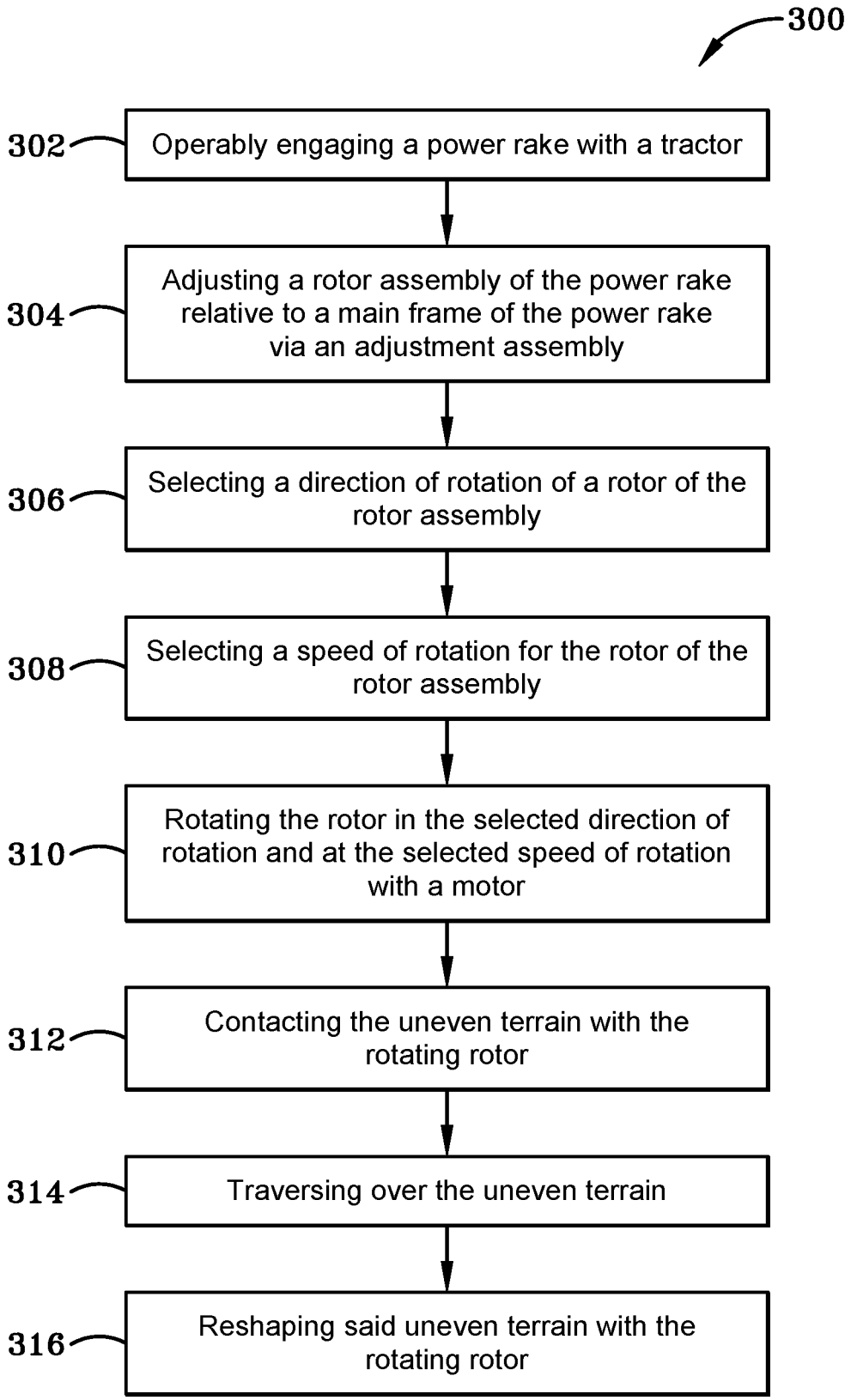
FIG. 16 (FIG. 16) is an exemplary method flowchart for reshaping an uneven terrain.

FIG. 16 illustrates a method 300 of reshaping uneven terrain. An initial step 302 of method 300 comprises operably engaging a power rake with a vehicle. Another step 304 comprises adjusting a rotor assembly of the power rake relative to a main frame of the power rake via an adjustment assembly. Another step 306 comprises selecting a direction of rotation of a rotor of the rotor assembly. Another step 308 comprises selecting a speed of rotation for the rotor of the rotor assembly. Another step 310 comprises rotating the rotor in the selected direction of rotation and at the selected speed of rotation with a motor. Another step 312 comprises contacting the uneven terrain with the rotating rotor. Another step 314 comprises traversing over the uneven terrain. Another step 316 comprises reshaping said uneven terrain with the rotating rotor.

In an exemplary embodiment, method 300 may include additional steps of reshaping uneven terrain. Optional steps may comprise operably engaging an attachment bar of a front axle with the main frame; and stabilizing a front end of the main frame with the front axle; these optional steps may be performed after step 302. Optional steps may comprise raising the rotor assembly until the rotor is out of contact with the uneven terrain; loosening a locking mechanism on a pivot assembly that engages the rotor assembly to the main frame; articulating the rotor; orienting the rotor at a desired angle relative to the main frame; tightening the locking mechanism to maintain the rotor at the desired angle; lowering the rotor to contact the uneven terrain; activating the rotor; and creating a swale in the uneven terrain; these optional steps may be performed after step 302 or before step 304. An optional step may comprise vertically adjusting the rotor assembly along a vertical axis of the main frame; this optional step may be performed after step 302 or before step 304. An optional step may comprise rotatably adjusting the rotor assembly—about a vertical axis of the main frame; this optional step may be performed after step 302 or before step 304. An optional step may comprise pivoting the rotor assembly relative to a horizontal axis of the main frame; this optional step may be performed after step 302 or before step 304. The step of selecting the speed of rotation of the rotor of the rotor assembly may optionally include selecting one of a first rotational speed and a second rotational speed that is greater than the first rotational speed. The step of selecting the direction of rotation of the rotor of the rotor assembly may optionally include selecting one of a clockwise direction and a counterclockwise direction. An optional step may comprise determining a vertical position of the rotor relative to the main frame via a depth measurement assembly; this optional step may be performed after step 312 or before 314.

Various inventive concepts may be embodied as one or more methods, of which an example has been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

While various inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

The above-described embodiments can be implemented in any of numerous ways. For example, embodiments of technology disclosed herein may be implemented using hardware, software, or a combination thereof. When implemented in software, the software code or instructions can be executed on any suitable processor or collection of processors, whether provided in a single computer or distributed among multiple computers. Furthermore, the instructions or software code can be stored in at least one non-transitory computer readable storage medium.

Also, a computer or smartphone utilized to execute the software code or instructions via its processors may have one or more input and output devices. These devices can be used, among other things, to present a user interface. Examples of output devices that can be used to provide a user interface include printers or display screens for visual presentation of output and speakers or other sound generating devices for audible presentation of output. Examples of control levers that can be used for a user interface include keyboards, and pointing devices, such as mice, touch pads, and digitizing tablets. As another example, a computer may receive input information through speech recognition or in other audible format.

Such computers or smartphones may be interconnected by one or more networks in any suitable form, including a local area network or a wide area network, such as an enterprise network, and intelligent network (IN) or the Internet. Such networks may be based on any suitable technology and may operate according to any suitable protocol and may include wireless networks, wired networks or fiber optic networks.

The various methods or processes outlined herein may be coded as software/instructions that is executable on one or more processors that employ any one of a variety of operating systems or platforms. Additionally, such software may be written using any of a number of suitable programming languages and/or programming or scripting tools, and also may be compiled as executable machine language code or intermediate code that is executed on a framework or virtual machine.

In this respect, various inventive concepts may be embodied as a computer readable storage medium (or multiple computer readable storage media) (e.g., a computer memory, one or more floppy discs, compact discs, optical discs, magnetic tapes, flash memories, USB flash drives, SD cards, circuit configurations in Field Programmable Gate Arrays or other semiconductor devices, or other non-transitory medium or tangible computer storage medium) encoded with one or more programs that, when executed on one or more computers or other processors, perform methods that implement the various embodiments of the disclosure discussed above. The computer readable medium or media can be transportable, such that the program or programs stored thereon can be loaded onto one or more different computers or other processors to implement various aspects of the present disclosure as discussed above.

The terms "program" or "software" or "instructions" are used herein in a generic sense to refer to any type of computer code or set of computer-executable instructions that can be employed to program a computer or other processor to implement various aspects of embodiments as discussed above. Additionally, it should be appreciated that according to one aspect, one or more computer programs that when executed perform methods of the present disclosure need not reside on a single computer or processor, but may be distributed in a modular fashion amongst a number of different computers or processors to implement various aspects of the present disclosure.

Computer-executable instructions may be in many forms, such as program modules, executed by one or more computers or other devices. Generally, program modules include routines, programs, objects, components, data structures, etc. that perform particular tasks or implement particular abstract data types. Typically, the functionality of the program modules may be combined or distributed as desired in various embodiments.

Also, data structures may be stored in computer-readable media in any suitable form. For simplicity of illustration, data structures may be shown to have fields that are related through location in the data structure. Such relationships may likewise be achieved by assigning storage for the fields with locations in a computer-readable medium that convey relationship between the fields. However, any suitable mechanism may be used to establish a relationship between information in fields of a data structure, including through the use of pointers, tags or other mechanisms that establish relationship between data elements.

All definitions, as defined and used herein, should be understood to control over dictionary definitions, definitions in documents incorporated by reference, and/or ordinary meanings of the defined terms.

"Logic", as used herein, includes but is not limited to hardware, firmware, software, and/or combinations of each to perform a function(s) or an action(s), and/or to cause a function or action from another logic, method, and/or system. For example, based on a desired application or needs, logic may include a software controlled microprocessor, discrete logic like a processor (e.g., microprocessor), an application specific integrated circuit (ASIC), a programmed logic device, a memory device containing instructions, an electric device having a memory, or the like. Logic may include one or more gates, combinations of gates, or other circuit components. Logic may also be fully embodied as software. Where multiple logics are described, it may be possible to incorporate the multiple logics into one physical logic. Similarly, where a single logic is described, it may be possible to distribute that single logic between multiple physical logics.

Furthermore, the logic(s) presented herein for accomplishing various methods of this system may be directed towards improvements in existing computer-centric or internet-centric technology that may not have previous analog versions. The logic(s) may provide specific functionality directly related to structure that addresses and resolves some problems identified herein. The logic(s) may also provide significantly more advantages to solve these problems by providing an exemplary inventive concept as specific logic structure and concordant functionality of the method and system. Furthermore, the logic(s) may also provide specific computer implemented rules that improve on existing technological processes. The logic(s) provided herein extends beyond merely gathering data, analyzing the information, and displaying the results. Further, portions or all of the present disclosure may rely on underlying equations that are derived from the specific arrangement of the equipment or components as recited herein. Thus, portions of the present disclosure as it relates to the specific arrangement of the components are not directed to abstract ideas. Furthermore, the present disclosure and the appended claims present teachings that involve more than performance of well-understood, routine, and conventional activities previously known to the industry. In some of the method or process of the present disclosure, which may incorporate some aspects of natural phenomenon, the process or method steps are additional features that are new and useful.

The articles "a" and "an," as used herein in the specification and in the claims, unless clearly indicated to the contrary, should be understood to mean "at least one." The phrase "and/or," as used herein in the specification and in the claims (if at all), should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc. As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

When a feature or element is herein referred to as being "on" another feature or element, it can be directly on the other feature or element or intervening features and/or elements may also be present. In contrast, when a feature or element is referred to as being "directly on" another feature or element, there are no intervening features or elements present. It will also be understood that, when a feature or element is referred to as being "connected", "attached" or "coupled" to another feature or element, it can be directly connected, attached or coupled to the other feature or element or intervening features or elements may be present. In contrast, when a feature or element is referred to as being "directly connected", "directly attached" or "directly coupled" to another feature or element, there are no intervening features or elements present. Although described or shown with respect to one embodiment, the features and elements so described or shown can apply to other embodiments. It will also be appreciated by those of skill in the art that references to a structure or feature that is disposed "adjacent" another feature may have portions that overlap or underlie the adjacent feature.

Spatially relative terms, such as "under", "below", "lower", "over", "upper", "above", "behind", "in front of", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if a device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly. Similarly, the terms "upwardly", "downwardly", "vertical", "horizontal", "lateral", "transverse", "longitudinal", and the like are used herein for the purpose of explanation only unless specifically indicated otherwise.

Although the terms "first" and "second" may be used herein to describe various features/elements, these features/elements should not be limited by these terms, unless the context indicates otherwise. These terms may be used to distinguish one feature/element from another feature/element. Thus, a first feature/element discussed herein could be termed a second feature/element, and similarly, a second feature/element discussed herein could be termed a first feature/element without departing from the teachings of the present invention.

An embodiment is an implementation or example of the present disclosure. Reference in the specification to "an embodiment," "one embodiment," "some embodiments," "one particular embodiment," "an exemplary embodiment," or "other embodiments," or the like, means that a particular feature, structure, or characteristic described in connection with the embodiments is included in at least some embodiments, but not necessarily all embodiments, of the invention. The various appearances "an embodiment," "one embodiment," "some embodiments," "one particular embodiment," "an exemplary embodiment," or "other embodiments," or the like, are not necessarily all referring to the same embodiments.

If this specification states a component, feature, structure, or characteristic "may", "might", or "could" be included, that particular component, feature, structure, or characteristic is not required to be included. If the specification or claim refers to "a" or "an" element, that does not mean there is only one of the element. If the specification or claims refer to "an additional" element, that does not preclude there being more than one of the additional element.

As used herein in the specification and claims, including as used in the examples and unless otherwise expressly specified, all numbers may be read as if prefaced by the word "about" or "approximately," even if the term does not expressly appear. The phrase "about" or "approximately" may be used when describing magnitude and/or position to indicate that the value and/or position described is within a reasonable expected range of values and/or positions. For example, a numeric value may have a value that is +/−0.1% of the stated value (or range of values), +/−1% of the stated value (or range of values), +/−2% of the stated value (or range of values), +/−5% of the stated value (or range of values), +/−10% of the stated value (or range of values), etc. Any numerical range recited herein is intended to include all sub-ranges subsumed therein.

Additionally, the method of performing the present disclosure may occur in a sequence different than those described herein. Accordingly, no sequence of the method should be read as a limitation unless explicitly stated. It is recognizable that performing some of the steps of the method in a different order could achieve a similar result.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of various embodiments of the disclosure are examples and the disclosure is not limited to the exact details shown or described.

What is claimed:

1. A power rake for attachment with a vehicle, the power rake comprising:

a main frame having a front end, a rear end, and a longitudinal axis defined therebetween;

an adjustment assembly operably engaged with the main frame, wherein the adjustment assembly is independently moveable relative to the main frame;

a rotor assembly operably engaged with the adjustment assembly and having a longitudinal support beam and a vertical support beam, wherein the rotor assembly is independently moveable relative to the main frame by the adjustment assembly; and a pivot assembly of the adjustment assembly operably engaged with the rotor assembly and operable to pivot the rotor assembly about the longitudinal axis of the main frame; the pivot assembly comprises:

an upper linkage assembly having an upper frame operably engaged with the main frame and a mounting plate slideably engaged with the upper frame and fixedly engaged with the vertical support beam; and a lower linkage assembly pivotably engaged with the longitudinal support beam.

2. The power rake of claim 1, wherein the rotor assembly is adapted to be pivoted via the adjustment assembly relative to a vertical axis of the main frame.

3. The power rake of claim 1, wherein the adjustment assembly and the rotor assembly are selectively vertically adjustable relative to a vertical axis of the main frame.

4. The power rake of claim 1, wherein the rotor assembly is selectively rotatably adjustable relative to a vertical axis of the main frame.

5. The power rake of claim 1, wherein the rotor assembly further comprises:

a rotor frame operably engaged with the adjustment assembly;

a rotor operably engaged with the rotor frame; and a motor operably connected to the rotor, wherein the motor selectively moves the rotor during operation.

6. The power rake of claim 5, wherein the rotor is selectively moveable between a clockwise rotation and a counterclockwise rotation.

7. The power rake of claim 5, wherein the rotor is selectively moveable between a first speed of rotation and a second speed of rotation that is greater than the first speed of rotation.

8. The power rake of claim 1, further comprising:

a front axle operably engaged with the main frame forwardly of the rotor assembly.

9. The power rake of claim 8, further comprising:
a longitudinal axis defined by the main frame;
wherein the front axle is independently rotatable about an axis parallel to the longitudinal axis of the main frame.

10. The power rake of claim 8, wherein the front axle further comprises:
a support bar;
at least one wheel operably engaged with the support bar;
an attachment bar operably engaged with the support bar, wherein the attachment bar is orthogonal to the support bar; and
a retaining pin operably engaged with the attachment bar to removably attach the attachment bar to the main frame.

11. The power rake of claim 10, wherein the front axle further comprises:
a vertical plate operably engaged with one of the support bar and the attachment bar;
a slot defined by the vertical plate; and
a retaining mechanism operably engaged with main frame, wherein the retaining mechanism restricts movement of the front axle relative to the main frame.

12. The power rake of claim 11, further comprising:
a locking mechanism which prevents movement of the front axle relative to the main frame.

13. The power rake of claim 1, wherein the pivot assembly further comprises:
frame a first opening defined by the upper frame and having an oblong shape;
a second opening defined by the mounting frame and having an oblong shape; wherein the second opening is oriented orthogonally to the first opening; and
a locking mechanism operably engaging the pivot frame with the mounting frame via the first opening and the second opening.

14. The power rake of claim 13, wherein the mounting plate is movable between a first position and a second position relative to the upper frame; and wherein a first end of the rotor is disposed at a first height and a second end of the rotor is disposed at a second height greater than the first height when the mounting plate is at the first position.

15. The power rake of claim 14, wherein the first end of the rotor is disposed at a third height and the second end of the rotor is disposed at a fourth height less than the third height when the mounting plate is at the second position.

16. The power rake of claim 1, further comprising:
a depth measurement assembly operably engaged with the pivot assembly and adapted to measure a height and a depth of the rotor relative to a bottom of the main frame.

17. A method of reshaping uneven terrain, the method comprising steps of:
operably engaging a power rake with a vehicle;
adjusting a rotor assembly of the power rake relative to a main frame of the power rake via pivot assembly of an adjustment assembly, the pivot assembly comprises:
an upper linkage assembly having an upper frame operably engaged with the main frame and a mounting plate slideably engaged with the upper frame and fixedly engaged with a vertical support beam of the rotor assembly; and
a lower linkage assembly pivotably engaged with a longitudinal support beam of the rotor assembly;
selecting a direction of rotation of a rotor of the rotor assembly;
selecting a speed of rotation for the rotor of the rotor assembly;
rotating the rotor in the selected direction of rotation and at the selected speed of rotation with a motor;
contacting the uneven terrain with the rotating rotor;
traversing over the uneven terrain; and
reshaping the uneven terrain with the rotating rotor.

18. The method of claim 17, further comprising:
operably engaging an attachment bar of a front axle with the main frame; and
stabilizing a front end of the main frame with the front axle.

19. The method of claim 17, further comprising:
raising the rotor assembly until the rotor is out of contact with the uneven terrain;
loosening a locking mechanism on the pivot assembly that engages the rotor assembly to the main frame;
articulating the rotor;
orienting the rotor at a desired angle relative to the main frame;
tightening the locking mechanism to maintain the rotor at the desired angle;
lowering the rotor to contact the uneven terrain;
activating the rotor; and
creating a swale in the uneven terrain.

20. The method of claim 17, further comprising:
vertically adjusting the rotor assembly along a vertical axis of the main frame.

21. The method of claim 17, further comprising:
rotatably adjusting the rotor assembly about a vertical axis of the main frame.

22. The method of claim 17, further comprising:
pivoting the rotor assembly relative to a horizontal axis of the main frame.

23. The method of claim 17, wherein selecting the speed of rotation of the rotor of the rotor assembly includes selecting one of a first rotational speed and a second rotational speed that is greater than the first rotational speed.

24. The method of claim 17, wherein selecting the direction of rotation of the rotor of the rotor assembly includes selecting one of a clockwise direction and a counterclockwise direction.

25. The method of claim 17, further comprising:
determining a vertical position of the rotor relative to the main frame via a depth measurement assembly.

* * * * *